US010656594B2

(12) United States Patent
Iwai et al.

(10) Patent No.: US 10,656,594 B2
(45) Date of Patent: May 19, 2020

(54) IMAGE FORMING APPARATUS HAVING OPTICAL PRINT HEAD

(71) Applicant: CANON KABUSHIKI KAISHA, Tokyo (JP)

(72) Inventors: Hitoshi Iwai, Abiko (JP); Shinichiro Hosoi, Tokyo (JP); Takehiro Ishidate, Tokyo (JP); Toshiki Momoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/400,999

(22) Filed: May 1, 2019

(65) Prior Publication Data

US 2019/0346809 A1 Nov. 14, 2019

(30) Foreign Application Priority Data

May 14, 2018 (JP) ..... 2018-093254

(51) Int. Cl.
*G03G 21/18* (2006.01)
*G03G 21/16* (2006.01)

(52) U.S. Cl.
CPC ..... *G03G 21/185* (2013.01); *G03G 21/1666* (2013.01)

(58) Field of Classification Search
CPC ..... G03G 21/185; G03G 21/1666
See application file for complete search history.

(56) References Cited

U.S. PATENT DOCUMENTS

2013/0164027 A1* 6/2013 Sato ..... G03G 21/1633 399/110
2013/0308983 A1* 11/2013 Takano ..... G03G 15/757 399/205
2017/0277115 A1* 9/2017 Yamamura ..... G03G 21/1623
2018/0095405 A1* 4/2018 Iwai ..... G03G 15/04054

FOREIGN PATENT DOCUMENTS

JP 2013134370 A 7/2013

* cited by examiner

*Primary Examiner* — Sandra Brase
(74) *Attorney, Agent, or Firm* — Canon U.S.A., Inc. IP Division

(57) ABSTRACT

When an optical print head is positioned at an evacuation position, at least a part of a region where a first member and a third link member overlap with each other in the direction of a pivotal axis of the third link member rotating relative to the first link member overlaps with a sliding portion in the pivotal axis direction.

24 Claims, 12 Drawing Sheets

IMAGE FORMING APPARATUS HAVING OPTICAL PRINT HEAD

BACKGROUND OF THE DISCLOSURE

Field of the Disclosure

The present disclosure relates to an image forming apparatus having a movement mechanism for moving an optical print head from an exposure position for exposing a photosensitive drum to an evacuation position farther away from the photosensitive drum than the exposure position.

Description of the Related Art

Image forming apparatuses such as printers and copying machines have an optical print head having a plurality of light emitting elements for exposing a photosensitive drum. Some optical print heads include a light emitting diode (LED) and organic electro luminescence (EL) as an example of a light emitting element. In some typical technique, those light emitting elements are arranged, for example, in a row or in two rows in zigzags along the direction of the rotational axis of the photosensitive drum. An optical print head is provided with a plurality of lenses for condensing light emitted from a plurality of light emitting elements onto a photosensitive drum. The plurality of lenses is arranged to face the surface of the photosensitive drum along the arrangement direction of light emitting elements between the plurality of light emitting elements and the photosensitive drum. The light emitted from the plurality of light emitting elements condenses on the surface of the photosensitive drum through the lenses, and an electrostatic latent image is formed on the photosensitive drum.

Since the photosensitive drum is a consumable, it is periodically replaced with a new one. A worker, such as a user or service engineer, in charge of photosensitive drum replacement can perform maintenance works for an image forming apparatus by replacing a drum unit having a photosensitive drum. A drum unit is configured to be attachable to and detachable from the main body of the image forming apparatus with the drum unit being inserted to and removed from a side face of the main body of the image forming apparatus. When the optical print head is positioned at the exposure position (the position which approaches to face the drum surface) for exposing the photosensitive drum to light, the distance between the lens and the surface of the photosensitive drum is very short. Thus, in replacing the drum unit, if the optical print head has not been moved to the evacuation position farther away from the photosensitive drum than the exposure position, the optical print head contacts the photosensitive drum, possibly causing damage to the surface of the photosensitive drum or the lens. To prevent the contact between the optical print head and the photosensitive drum in replacing the drum unit, the optical print head needs to be sufficiently away from the photosensitive drum when the optical print head is positioned at the evacuation position.

Japanese Patent Application Laid-Open No. 2013-134370 discusses a movement mechanism for moving an optical print head between an exposure position and an evacuation position. The movement mechanism includes a holding member and a slide member (sliding portion) which slides in the direction of the rotational axis of the photosensitive drum. The movement mechanism further includes a pair of first link members and a second link member on each of the front and the back sides.

The pair of the first link members (third link member) and the second link member (first link member) disposed on a front part of the movement mechanism will be described below. The pair of the first link members and the second link member are rotatably connected with each other centering on respective pivot portions to configure a pantograph mechanism. On a front part of the slide member, the pair of first support members is disposed in such a manner that the members are laterally disposed across a gap. Each of the mating first support members is provided with a first guide boss having an insertion hole formed therein. The second link member is provided with an insertion slot on one end side. The second link member is disposed between the mating first support members, and an insertion shaft is inserted into the two insertion holes and the insertion slot. Thus, the second link member is rotatably connected to the slide member. On the other hand, the other end side of the second link member is rotatably connected to a fitting hole provided on the holding member. One end side of the pair of the first link members is rotatably connected to a main body side fitting portion fixed to the main body. The other end side of the pair of the first link members is rotatably and anteroposteriorly movably connected to a guide hole provided on the holding member.

In the above-described configuration, when the slide member slides, the pair of the first link members and the second link member rotate relative to each other, and the optical print head reciprocally moves between the exposure and the evacuation positions.

However, the configuration discussed in Japanese Patent Application Laid-Open No. 2013-434370 has the following issue. With the rotation of the first and the third link members, a region (intersection region) where the first and the third link members laterally overlap with each other moves in a direction away from the photosensitive drum. With this movement of the intersection region, the optical print head also moves in a direction away from the photosensitive drum. In the configuration discussed in the Japanese Patent Application Laid-Open No. 2013-134370, a part of the slide member is positioned in the region where the region anteroposteriorly overlapping with the first link member behind the first link member laterally overlaps with the region anteroposteriorly overlapping with the third link member in front of the third link member. Thus, the intersection region can be positioned only above the slide member. As a result, there has been a limitation on the amount by which the optical print head is movable in a direction away from the photosensitive drum.

SUMMARY OF THE DISCLOSURE

According to an aspect of the present disclosure, an image forming apparatus includes a photosensitive drum configured to be rotatable relative to a main body of the image forming apparatus. An optical print head is configured to be movable from an exposure position for exposing the photosensitive drum to light to a retracted position farther away from the photosensitive drum than the exposure position. A sliding portion is configured to movably slide from a front part of the main body of the image forming apparatus to a back part of the main body along a longitudinal direction of the optical print head. A first link member rotatably connected to the sliding portion and the optical print head. A second link member rotatably connected to the sliding portion and the optical print head. One end side of the first link member in a longitudinal direction of the first link member is rotatably connected to a front part of the sliding portion in a longitudinal direction of the optical print head, and the other end side of the first link member in a longitudinal direction of the first link member is rotatably connected to a front part of the optical print head in a longitudinal direction of the optical print head, and the one end side of the first link member in a longitudinal direction of the first link member is positioned downstream, in a sliding movement direction in which the sliding portion slides, of the other end side of the first link member in the longitudinal direction of the first link member. Furthermore, one end side of the second link member in a longitudinal direction of the second link member is rotatably connected to a back part of the sliding portion in a longitudinal direction of the optical print head, and the other end side of the second link member in a longitudinal direction of the second link member is rotatably connected to a back part of the optical print head in a longitudinal direction of the optical print head, and the one end side of the second link member in a longitudinal direction of the second link member is positioned at a downstream side of the other end side of the second link member in a longitudinal direction of the second link member in the sliding movement direction. And, a third link member is rotatably connected to the main body of the image forming apparatus and the first link member. Additionally, one end side of the third link member in the longitudinal direction of the third link member which arranged on an upstream side of the one end side of the first link member in the longitudinal direction of the first link member in the sliding movement direction is rotatable connected to the main body of the image forming apparatus, and the other end side of the third link member in the longitudinal direction of the third link member which arranged on downstream side of the one end side of the third link member in the longitudinal direction of the third link member in the sliding movement direction is connected to the first link member. As a result, the first link member, the second link member, and the third link member rotate in association with sliding movement of the sliding portion, and move the optical print head from the exposure position to the retracted position. When the optical print head is positioned at the retracted position, at least a part of a region where the first and the third link members overlap with each other in a pivotal axis direction overlaps with the sliding portion in the pivotal axis direction, the pivotal axis direction being the direction of a pivotal axis of the third link member rotating relative to the first link member.

Further features and aspects of the present disclosure will become apparent from the following description of example embodiments with reference to the attached drawings.

BRIEF DESCRIPTION OF THE DRAWINGS

FIGS. 4A to 4C2 are schematic views illustrating an example substrate, light emitting diode (LED) chips, and a lens array.

DESCRIPTION OF THE EMBODIMENTS

Various example embodiments for embodying the present disclosure will be described below with reference to the accompanying drawings. The components described in the following example embodiments are illustrative and are not meant to limit the scope of the present disclosure to the following example embodiments.

(Example Image Forming Apparatus)

Figure 1A:
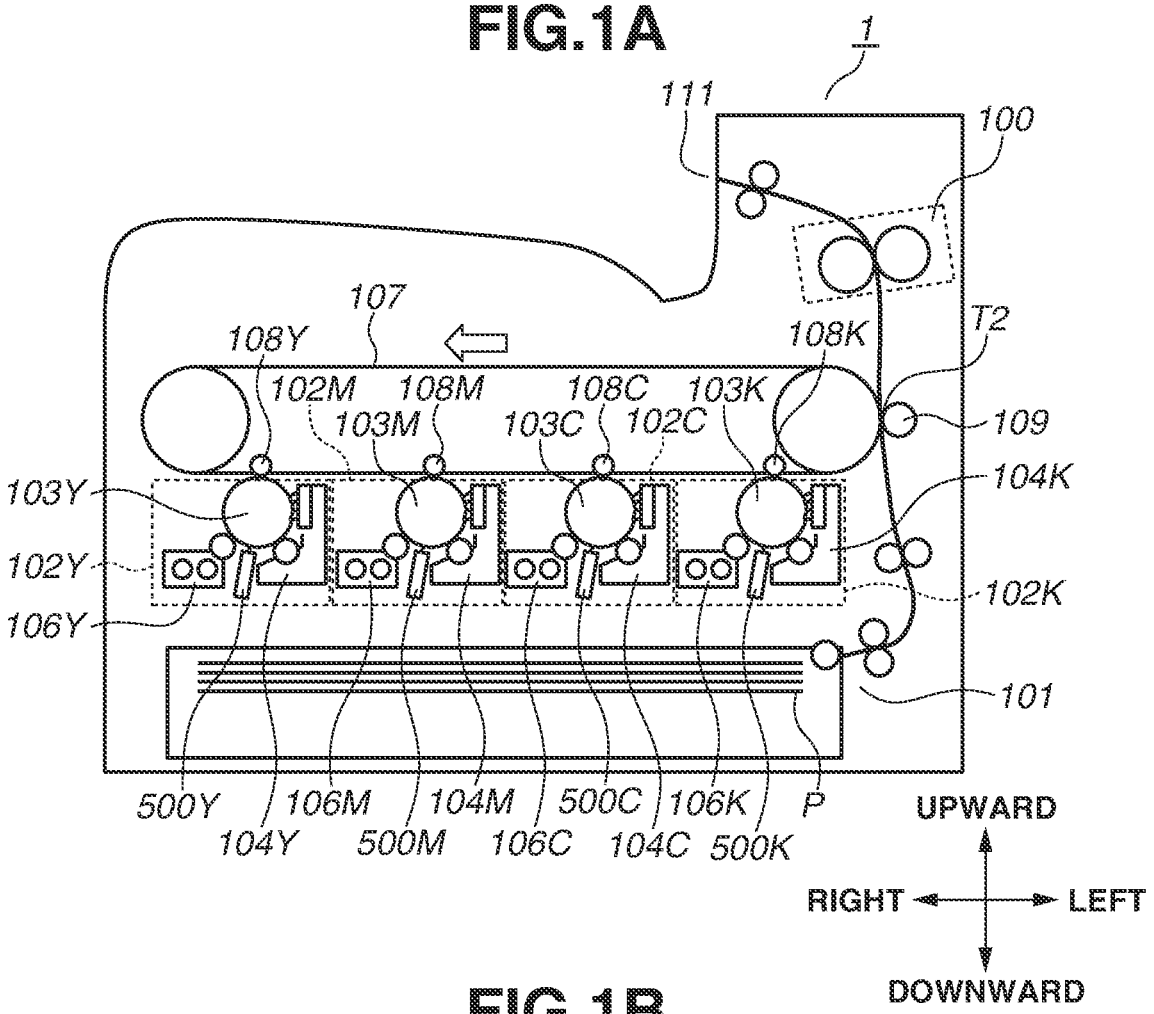
FIGS. 1A and 1B are cross-sectional views schematically illustrating an example image forming apparatus.

An overall configuration of an image forming apparatus 1 will be described below. FIG. 1A is a schematic sectional view illustrating the image forming apparatus 1, While the image forming apparatus 1 illustrated in FIG. 1A is a color printer (single function printer (SFP)) not having a reading apparatus, the image forming apparatus 1 according to the example embodiments may be a copying machine having a reading apparatus. The image firming apparatus 1 according to the example embodiments are not limited to a color image forming apparatus having a plurality of photosensitive drums 103, as illustrated in FIG. 1A, and may be a color image forming apparatus having a single photosensitive drum 103 or an image forming apparatus for forming a monochrome image.

The image forming apparatus 1 illustrated in FIG. 1A includes four different image forming units 102Y, 102M, 102C, and 102K for forming an yellow, a magenta, a cyan, and a black toner image, respectively (hereinafter these image forming units are collectively referred to as "image forming units 102"). The image forming units 102Y, 102M, 102C, and 102K include photosensitive drums 103Y, 1034, 103C, and 103K, respectively (hereinafter these photosensitive drums are collectively referred to as "photosensitive drums 103"). The image forming units 102Y, 102M, 102C, and 102K further include charging units 104Y, 104M, 104C, and 104K, respectively, for charging the photosensitive drums 103Y, 103M, 103C, and 103K, respectively (hereinafter these charging units are collectively referred to as "charging units 104"). The image forming units 102Y, 102M, 102C, and 102K, further include light emitting diode (LED) exposure units 500Y, 500M, 500C, and 500K, respectively, as exposure light sources for emitting light to which the photosensitive drums 103Y, 103M, 103C, and 103K, respectively, are exposed (hereinafter these exposure units are collectively referred to as "exposure units 500"). The image forming units 102Y, 102M, 102C, and 102K further include development units 106Y, 106M, 106C, and 106K, respectively, for developing an electrostatic latent image on the photosensitive drums 103 with toner to form toner images of respective colors on the photosensitive drums 103 (hereinafter these development units are collectively referred to as "development units 106"). The symbols Y, M, C, and K supplied to reference numerals denote the toner colors.

Figure 1B:
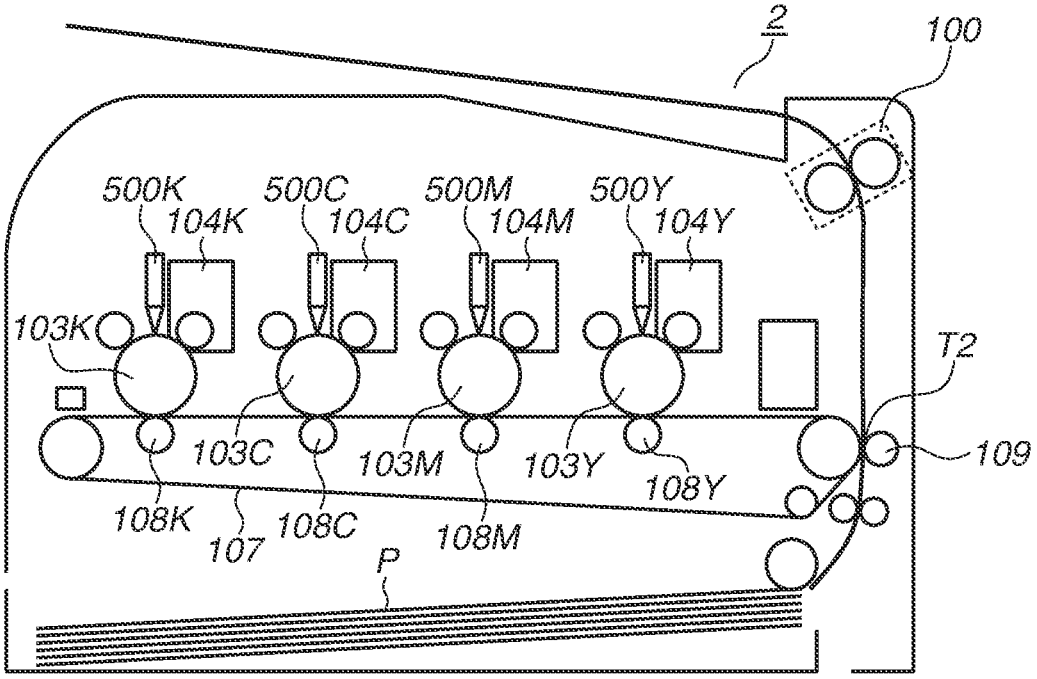

The image forming apparatus 1 illustrated in FIG. 1A is an image forming apparatus employing "lower surface exposure method" for exposing the photosensitive drums 103 to light from below. While the following descriptions will be provided on the premise that the image forming apparatus 1 employs the lower surface exposure method, an image forming apparatus employing the "upper surface exposure method" for exposing the photosensitive drums 103 to light from above, such as an image forming apparatus 2 illustrated in FIG. 1B is also applicable as example embodiments. Referring to FIG. 1B, portions indicating the same configuration as those illustrated in FIG. 1A are assigned the same reference numerals.

The image forming apparatus 1 includes an intermediate transfer belt 107 on which toner images formed on the photosensitive drums 103 are transferred, and primary transfer rollers 108 (primary transfer rollers 108Y, 108M, 1080, and 108K) for sequentially transferring toner images formed on the photosensitive drums 103 onto the intermediate transfer belt 107. The image forming apparatus 1 further includes a secondary transfer roller 109 for secondarily transferring a toner image on the intermediate transfer belt 107 to recording paper P conveyed from a paper feed unit 101, and a fixing unit 100 for fixing the secondarily transferred image to the recording paper P.

(Example Image Forming Process)

The exposure unit 500Y exposes the surface of the photosensitive drum 103Y charged by the charging unit 104Y to light. Thus, an electrostatic latent image is formed on the photosensitive drum 103Y. Then, the development unit 106Y develops the electrostatic latent image formed on the photosensitive drum 103Y with yellow toner. An yellow toner image developed on the surface of the photosensitive drum 103Y is transferred onto the intermediate transfer belt 107 by the primary transfer roller 108Y. A magenta, a cyan, and a black toner image are also transferred onto the intermediate transfer belt 107 in similar image forming processes.

The toner images of respective colors transferred onto the intermediate transfer belt 107 are conveyed to a secondary transfer portion T2 by the intermediate transfer belt 107. The secondary transfer roller 109 disposed at the secondary transfer portion T2 is applied with a transfer bias for transferring a toner mage onto the recording paper P. The toner image conveyed to the secondary transfer portion T2 is transferred from the paper feed unit 101 to the conveyed recording paper P by the transfer bias of the secondary transfer roller 109. The recording paper P with the toner image transferred thereon is conveyed to the fixing unit 100. The fixing unit 100 fixes the toner image to the recording paper P with heat and pressure. The recording paper P having undergone fixing processing by the fixing unit 100 is discharged onto a discharge unit 111.

(Example Drum Units and Development Units)

Figure 2A:
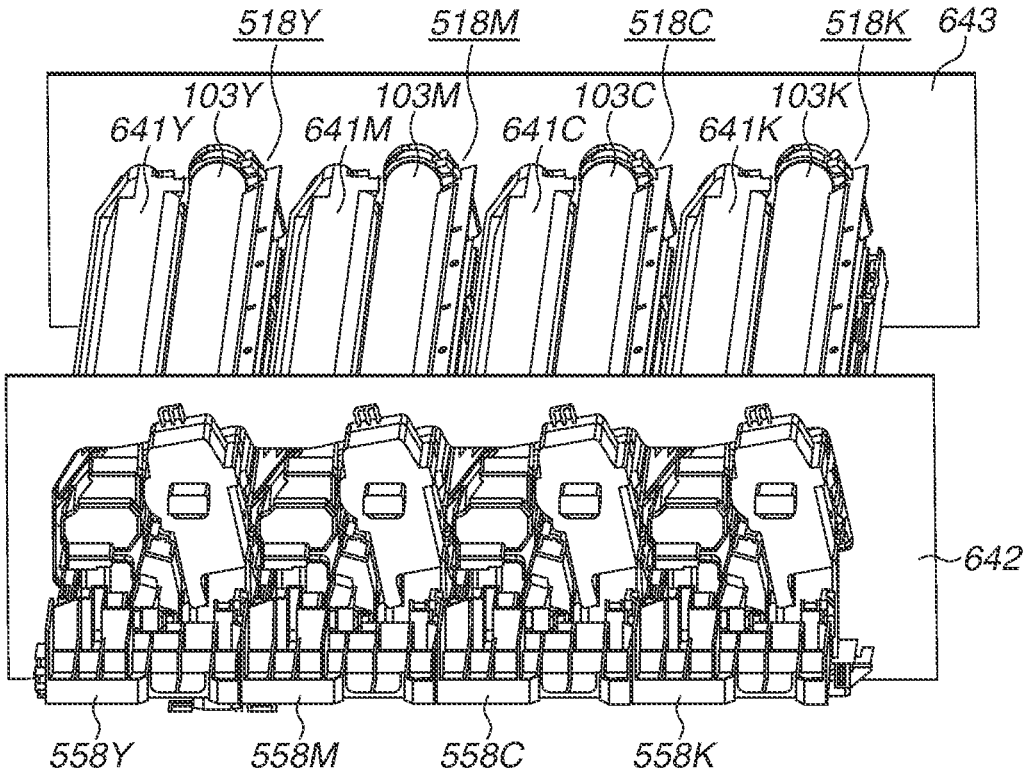
FIGS. 2A and 2B are perspective views illustrating the periphery of drum units in the example image forming apparatus.
Figure 2B:
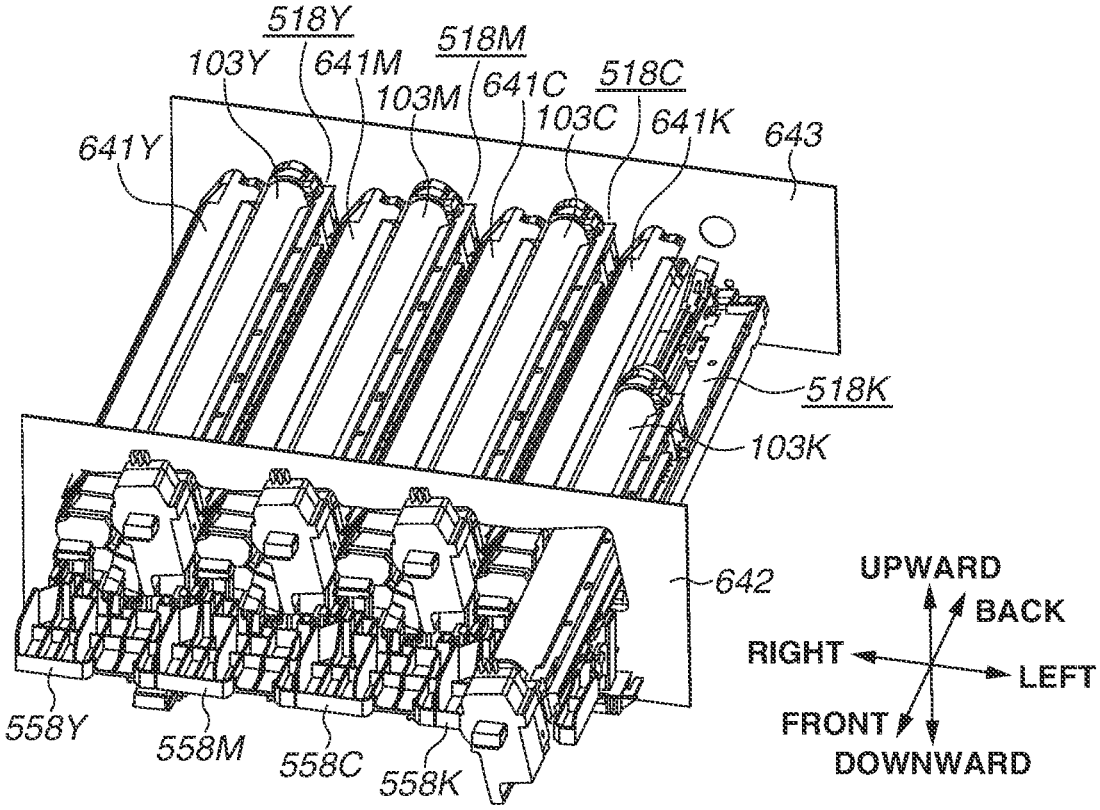

Referring now to FIGS. 2A and 2B, drum units 518Y, 518M, 518C, and 518K including the photosensitive drums 103 are attached to the image forming apparatus 1 (hereinafter these drum units are collectively referred to as "drum units 518"). The drum units 518 are cartridges which are replaced by a worker, such as a user and a maintenance engineer. A drum unit 518 rotatably supports a photosensitive drum 103. More specifically, the photosensitive drum 103 is rotatably supported by the frame member of the drum unit 518. The drum unit 518 may not include the charging unit 104 or a cleaning apparatus.

Development units 641Y, 641M, 641C, and 641K as different units from the drum units 518 are attached to the image forming apparatus 1 according to the present example embodiment (hereinafter these development units are collectively referred to as "development units 641"). A development unit 641 according to the present example embodiment is a cartridge in which the development unit 106 illustrated in FIG. 1A is integrated with a toner containing unit. The development unit 106 includes a development sleeve (not illustrated) for bearing a development agent. The development unit 641 includes a plurality of gears for rotating a screw for agitating toner and career. When these gears degrade over time, the worker removes the development unit 641 from the main body of the image forming apparatus 1 to replace the development unit 641 with a new one. A process cartridge in which the drum unit 518 and the development unit 641 are integrated is also applicable as an example embodiment of the drum unit 518 and the development unit 641.

FIG. 2A is a perspective view illustrating an overall structure around the drum unit 518 and the development unit 641 included in the image forming apparatus 1. FIG. 2B illustrates a state where the drum unit 518 is being inserted into the image forming apparatus 1 from the outside of the apparatus main body.

As illustrated in FIG. 2A, the image forming apparatus 1 includes a front side plate 642 formed by a sheet metal, and a back side plate 643 formed also by a sheet metal. The front side plate 642 is a side wall provided on the front side of the image forming apparatus 1. The front side plate 642 forms a part of the housing of the apparatus main body on the front side of the main body of the image forming apparatus 1. The back side plate 643 is a side wall provided on the back side of the image forming apparatus 1. The back side plate 643 forms a part of the housing of the apparatus main body on the back side of the main body of the image forming apparatus 1. As illustrated in FIG. 2A, the front side plate 642 and the back side plate 643 are disposed to face each other and are cross-linked by a sheet metal (not illustrated) as a beam therebetween. Each of the front side plate 642, the back side plate 643, and the beam (not illustrated) configures a part of the frame member of the image forming apparatus 1.

Herein, with respect to the image forming apparatus 1 or components thereof according to the present example embodiment, the term "front (side)" is associated with the side on which the drum units 518 are inserted into and removed from the apparatus main body, i.e., the side on which the user stands when operating the image forming apparatus 1, and the back side is opposite the front side.

The front side plate 642 is provided with an opening so that the drum units 518 and the development units 641 can be inserted into and removed from the image forming apparatus 1 on the front side of the image forming apparatus 1. The drum units 518 and the development units 641 are attached to predetermined positions (attachment positions) in the main body of the image forming apparatus 1 through the opening. The image forming apparatus 1 includes covers 558Y, 558M, 558C, and 558K for covering the front side of both the drum units 518 and the development units 641 attached at the attachment positions (hereinafter these covers are collectively referred to as "covers 558"). One end side of a cover 558 is fixed to the main body of the image forming apparatus 1 by a hinge in such a manner that the cover 558 is rotatable relative to the main body of the image forming apparatus 1 by the hinge. The worker opens the cover 558, takes out the drum unit 518 or the development unit 641 from the main body, inserts a new drum unit 518 or a new development unit 641, and closes the cover 558, thus completing a replacement work.

As illustrated in FIGS. 2A and 2B, the front, the back, the right-hand, and the left-hand sides of the apparatus main body in the following descriptions will be defined below. The front side is defined as the side closer to the front side plate 642 (also referred to as a term associated with "front"). The back side is defined as the side closer to the back side plate 643 (also referred to as terms associated with "back" or "behind"). With reference to the photosensitive drum 103K with an electrostatic latent image for a black toner image formed thereon, the right-hand side is defined as the side on which the photosensitive drum 103Y with an electrostatic latent image for an yellow toner image formed thereon is disposed. With reference to the photosensitive drum 103Y with an electrostatic latent image for an yellow toner image formed thereon, the left-hand side is defined as the side on which the photosensitive drum 103K with an electrostatic latent image for a black toner image formed thereon is disposed. The upward and downward directions will also be defined below. The upward direction is defined as the direction perpendicular to the front-back direction and lateral directions defined above and is the vertically upward direction. The downward direction is defined as the direction perpendicular to the front-back direction and lateral directions defined above and is the vertically downward direction. The front, the back, the right-hand, and the left-hand sides, the upward direction, and the downward direction defined above are illustrated in FIG. 2B. In addition, the direction of the rotational axis of the photosensitive drum 103 in the following descriptions indicates a direction which substantially coincides with the front-back direction illustrated in FIG. 2B.

(Example Exposure Units)

An exposure unit 500 including an optical print head 105 will be described below. Examples of exposure methods applied to electrophotographic image forming apparatuses include a laser beam scanning exposure method in which the irradiation beam of a semiconductor laser is deflected by a rotating polygon mirror and a photosensitive drum is exposed to light through an f-θ lens. The "optical print head 105" according to the present example embodiment is used for an LED exposure method in which the photosensitive drum 103 is exposed to light by light emitting elements, such as LEDs, arranged along the direction of the rotational axis of the photosensitive drum 103. The optical print head 105 is not used for the above-described laser beam scanning exposure method.

Figure 3:
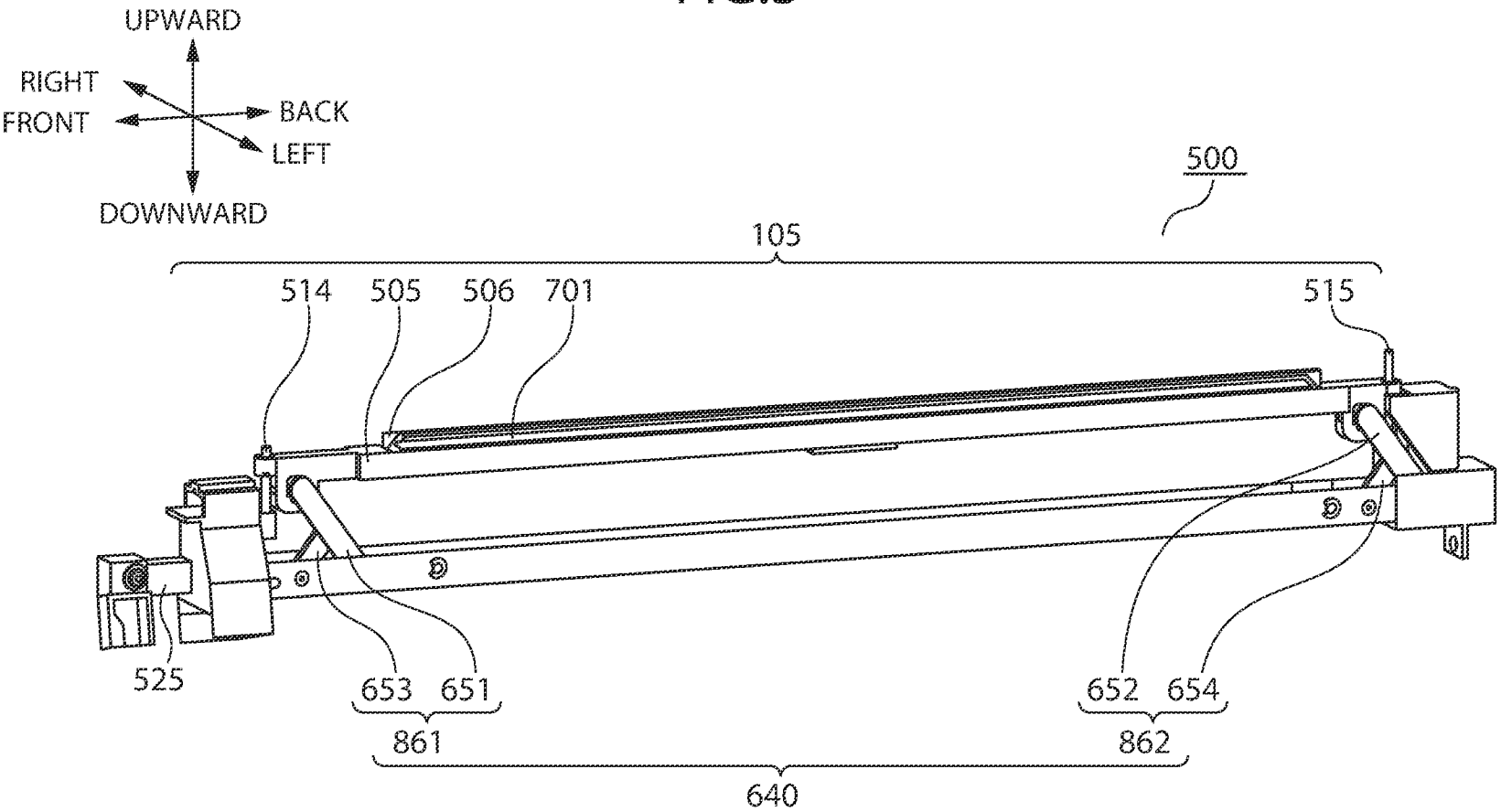
FIG. 3 is a perspective view schematically illustrating an example exposure unit.

The exposure unit 500 according to the present example embodiment is disposed vertically below the rotational axis of the photosensitive drum 103, and an LED 503 included in the optical print head 105 exposes the photosensitive drum 103 to light from below. However, the exposure unit 500 may be disposed vertically above the rotational axis of the photosensitive drum 103, and the LED 503 may expose the photosensitive drum 103 to light from above (refer to FIG. 1B). FIG. 3 is a perspective view schematically illustrating the exposure unit 500 included in the image forming apparatus 1 according to the present example embodiment.

Referring to FIG. 3, the exposure unit 500 includes the optical print head 105 and a movement mechanism 640. The optical print head 105 includes a lens array 506, a substrate 502 (not illustrated in FIG. 3), a holder 505, a first contact pin 514, and a second contact pin 515.

When the first contact pin 514 and the second contact pin 515 abut against the drum unit 518, a gap is formed between the lens array 506 and the photosensitive drum 103, thus determining the position of the optical print head 105 relative to the photosensitive drum 103 at the time of image forming. The movement mechanism 640 includes a first link mechanism 861, a second link mechanism 862, and a slide member (sliding portion) 525. The first link mechanism 861 includes link members 651 and 653. The second link mechanism 862 includes link members 652 and 654. The slide member 525 slides in the front-back direction with an opening/closing operation of the cover 558 (not illustrated). In association with the slide motion (sliding movement) of the slide member 525, the first link mechanism 861 and the second link mechanism 862 are driven to move the optical print head 105 up and down. Operations of the movement mechanism 640 will be described in detail below. The portions of the frame member of the drum unit 518 against which the contact pins 514 and 515 abut are provided with fitting holes. For example, the tips of the contact pins 514 and 515 fit into the fitting holes by about 5 mm. Thus, the optical print head 105 is accurately positioned relative to the photosensitive drum 103.

Prior to the description of the structure of the optical print head 105, the holder 505 will be described below. The holder 505 holds the substrate 502 and the lens array 506 (described below). While the holder 505 is made of resin from the viewpoint of the weight and cost reduction of the optical print head 105 itself in the present example embodiment, the holder 505 may be made of a metal.

The exposure unit 500 is disposed vertically below the rotational axis of the photosensitive drum 103, and the LED 503 included in the optical print head 105 exposes the photosensitive drum 103 to light from below. The exposure unit 500 may be disposed vertically above the rotational axis of the photosensitive drum 103, and the LED 503 included in the optical print head 105 may expose the photosensitive drum 103 to light from above.

Figure 4A:
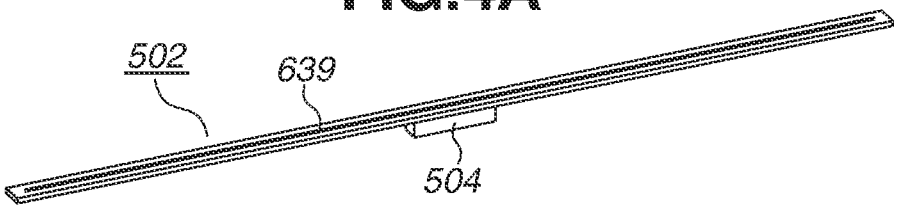
Figure 4A:
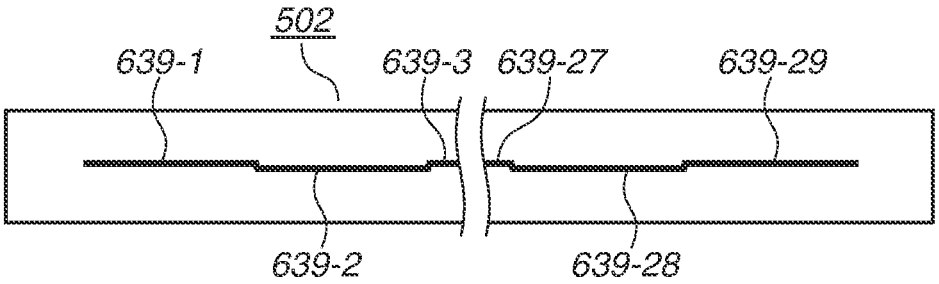
Figure 4A:
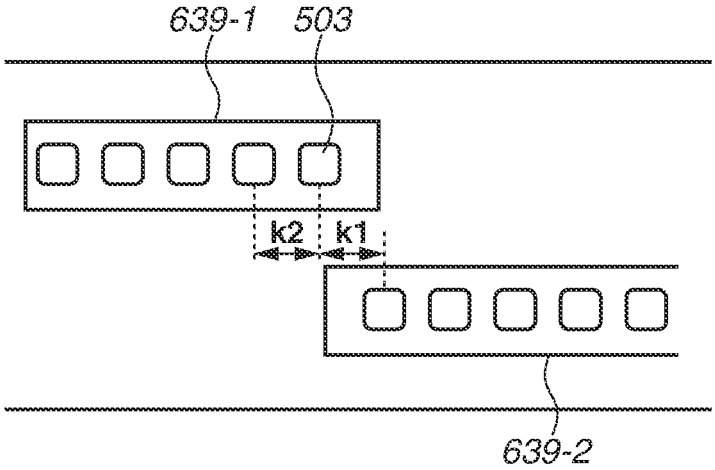
Figure 4A:
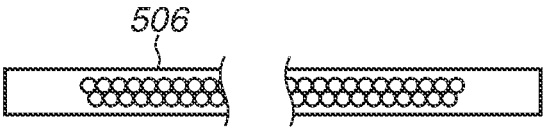
Figure 4A:
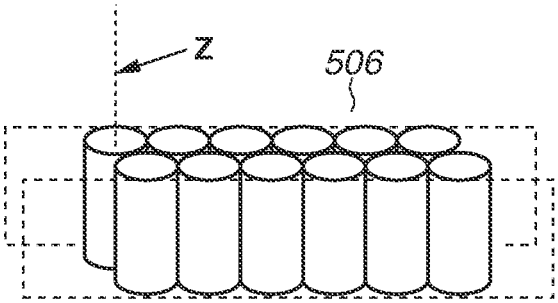

The substrate 502 held by the holder 505 will be described below. FIG. 4A is a perspective view schematically illustrating the substrate 502. FIG. 4B1 illustrates the arrangements of a plurality of the LEDs 503 disposed on the substrate 502. FIG. 4B2 is an enlargement view of FIG. 4B1.

The substrate 502 is provided with LED chips 639 mounted thereon. As illustrated in FIG. 4A, the LED chips 639 are disposed on one side surface of the substrate 502, and a connector 504 is disposed on the other side surface of the substrate 502. The substrate 502 is provided with wiring for supplying signals to the LED chips 639. One end side of a flexible flat cable (FFC) is connected to the connector 504. The main body of the image forming apparatus 1 includes the substrate 502. The substrate 502 includes a control unit and a connector. The other end of the FFC is connected to this connector. Control signals are input from the control unit of the main body of the image forming apparatus 1 to the substrate 502 via the FFC and the connector 504. The LED chips 639 are driven by the control signals input to the substrate 502.

The LED chips 639 mounted on the substrate 502 will be described in more detail below. As illustrated in FIGS. 4B1 and 4B2, the LED chips 639-1 to 639-29 (including a total of 29 LED chips) are arranged on one side surface of the substrate 502. In each of the LED chips 639-1 to 639-29, a plurality of LEDs (examples of light emitting elements) is arranged in a single row along the longitudinal direction of the LED chips 639. Each of the LED chips 639-1 to 639-29 includes 516 LEDs. A distance k2 between the centers of adjacent LEDs in the longitudinal direction of each LED chip 639 corresponds to the resolution of the image forming apparatus 1. The resolution of the image forming apparatus 1 according to the present example embodiment is 1200 dots per inch (dpi). Thus, in each of the LED chips 639-1 to 639-29, LEDs are arranged in a single row in such a manner that the distance between the centers of adjacent LEDs is 21.16 μm in the longitudinal direction of the LED chips 639. Accordingly, the optical print head 105 according to the present example embodiment provides an exposure range of about 316 mm. The photosensitive layer of a photosensitive drum 103 is formed with a width of 316 mm or more. Since the length of long sides of A4 size recording paper and the length of short sides of A3 size recording paper are 297 mm, the optical print head 105 according to the present example embodiment has an exposure range over which image forming on A4- and A3-size recording paper is possible.

The LED chips 639-1 to 639-29 are arranged in alternation in two rows along the direction of the rotational axis of the photosensitive drum 103. More specifically, as illustrated in FIG. 4B1, odd-numbered LED chips 639-1, 639-3, . . . , and 639-29 counted from left to right are mounted in a row in the longitudinal direction of the substrate 502, and even-numbered LED chip 639-2, 639-4, . . . , and 639-28 are mounted in a row in the longitudinal direction of the substrate 502. By arranging the LED chips 639 in this way, as illustrated in FIG. 4B2, a distance k1 between the center of the LED disposed at one end of one of adjacent LED chips 639 and the center of the LED disposed at the other end of the other of adjacent LED chips 639 can be made equal to the distance k2 between the centers of adjacent LEDs on one LED chip 639 in the longitudinal direction of the LED chips 639.

Although, in the configuration according to the present example embodiment, a plurality of LEDs is used as an exposure light source, organic electro luminescence (EL) elements may be used as an exposure light source.

The lens array 506 will be described below. FIG. 4C1 is a schematic view illustrating the lens array 506 when viewed from the side of the photosensitive drum 103, FIG. 4C2 is a perspective view schematically illustrating the lens array 506. As illustrated in FIG. 4C1, the plurality of lenses is arranged in two rows along the arrangement direction of the plurality of the LEDs 503. The lenses are arranged in zigzags in such a way that one of lenses in one row contacts two lenses adjacent in the lens arrangement direction in the other row. Each lens is a column-shaped rod lens made of glass. The material of the lenses is not limited to glass and may also be plastic. The shape of the lenses is not limited to a column and may be a polygon, such as a hexagonal column.

The dotted line Z illustrated in FIG. 4C2 indicates the optical axis of a lens. The optical print head 105 is moved by the above-described movement mechanism 640 in a direction almost along the optical axis of the lens indicated by the dotted line Z. The optical axis of a lens herein means the line connecting the center of the light emitting plane of the lens and the focus of the lens. As illustrated in FIG. 4C2, radiation light emitted from the LEDs 503 is incident on the lenses included in the lens array 506. The lenses have the function of condensing the incident radiation light on the surface of the photosensitive drum 103. The attachment position of the lens array 506 relative to a lens attachment portion 701 (FIG. 3) at the assembly time of the optical print head 105 is adjusted so that the distance between the light emitting plane of the LEDs and the light incidence plane of the lenses becomes substantially equal to the distance between the light emitting plane of the lenses and the surface of the photosensitive drum 103.

(Example Movement Mechanism)

Figure 5A:
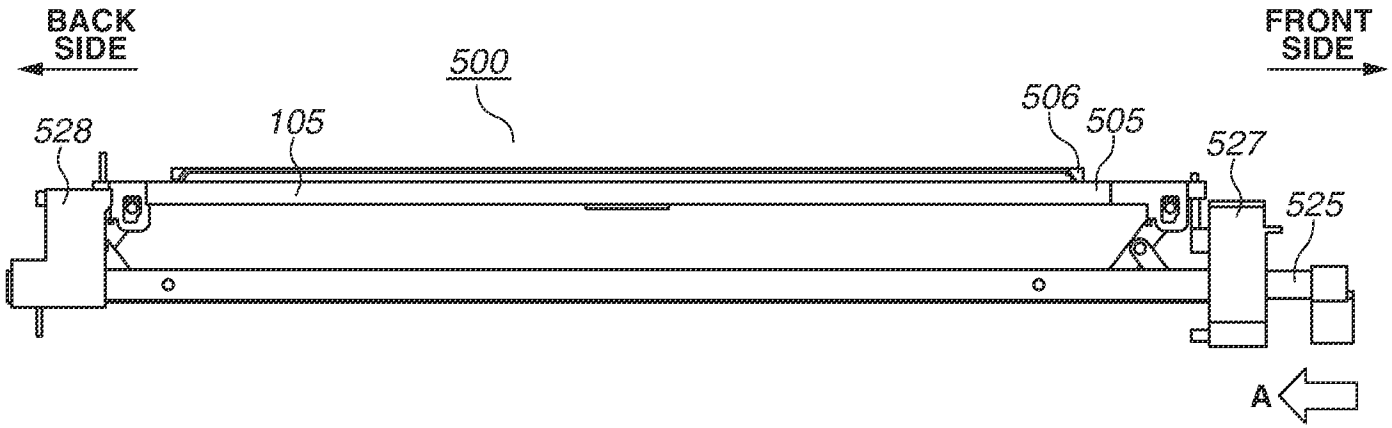
FIGS. 5A and 5B are side views schematically illustrating an example optical print head.
Figure 5B:
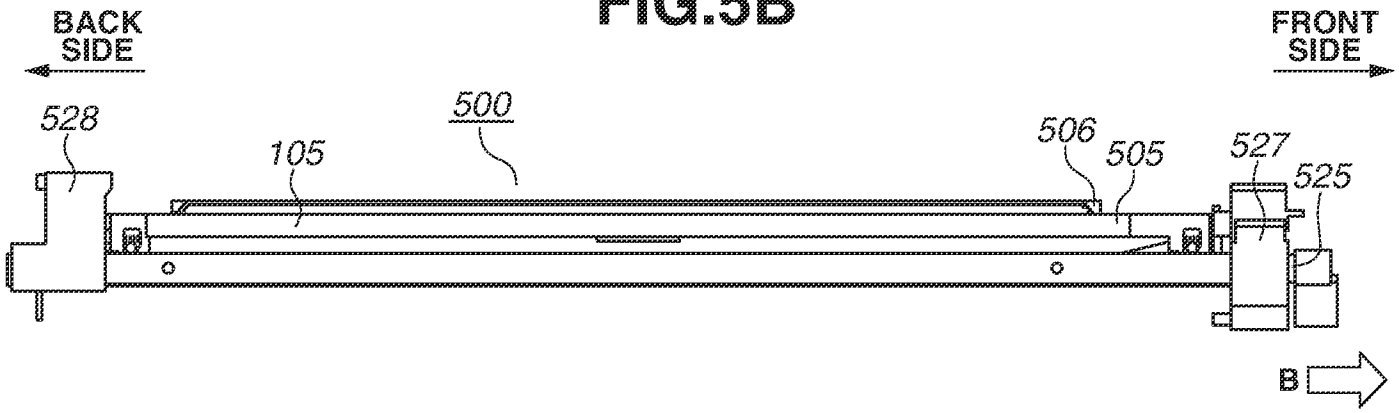

As described above with reference to FIGS. 2A and 2B, in replacing a drum unit 518, the drum unit 518 is slid in the direction from the back to the front side of the apparatus main body in the image forming apparatus 1 according to the present example embodiment. If the drum unit 518 is moved in a state where the optical print head 105 is positioned near the surface of the photosensitive drum 103, the surface of the photosensitive drum 103 contacts the optical print head 105, possibly causing damage to the surface of the photosensitive drum 103. In addition, the frame member of the drum unit 518 contacts the lens array 506, possibly causing damage also to the lens array 506. To address this, a structure for making the optical print head 105 reciprocally move between the exposure position (FIG. 5A) where the photosensitive drum 103 is exposed to light and the evacuation position (FIG. 5B) more away from the drum unit 518 than the exposure position. When the slide member 525 slides in the direction of the arrow A in a state where the optical print head 105 is positioned at the exposure position (FIG. 5A), the optical print head 105 moves to the evacuation position (FIG. 5B). On the other hand, when the slide member 525 slides in the direction of the arrow B in a state where the optical print head 105 is positioned at the evacuation position (FIG. 5B), the optical print head 105 moves to the exposure position (FIG. 5A). The term "slide motion direction" herein refers to the direction in which the slide member 525 is to be moved in order to move the optical print head 105 from the exposure to the evacuation position. Referring to FIGS. 5A and 5B as an example, the direction of the arrow A coincides with the "slide motion direction". The worker moving the slide member 525 in the slide motion direction moves the optical print head 105 in a direction away from the photosensitive drum 103.

Figure 6A:
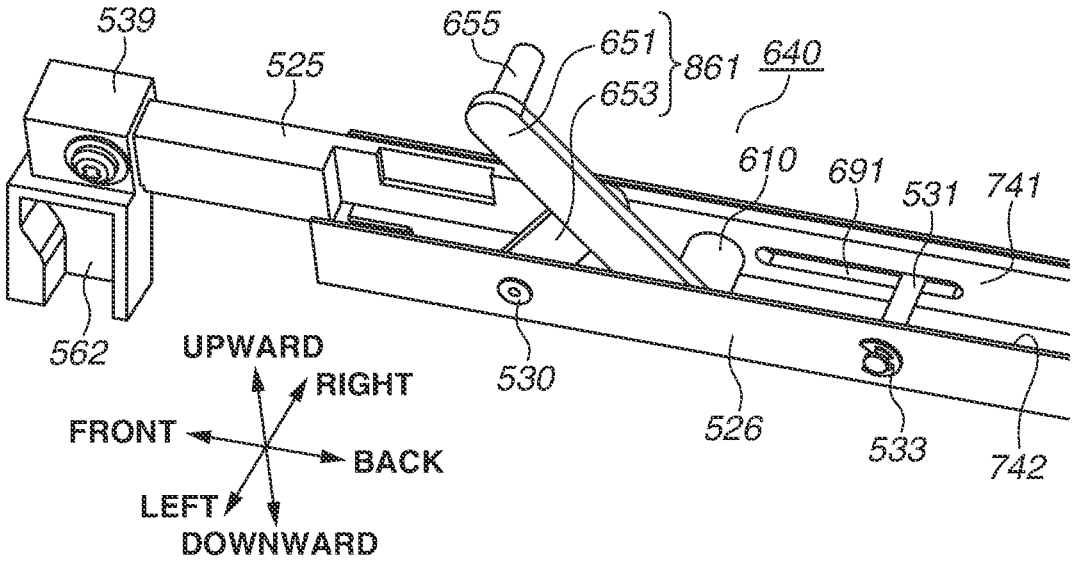
FIGS. 6A and 6B are perspective views illustrating a front part of an example movement mechanism.
Figure 6B:
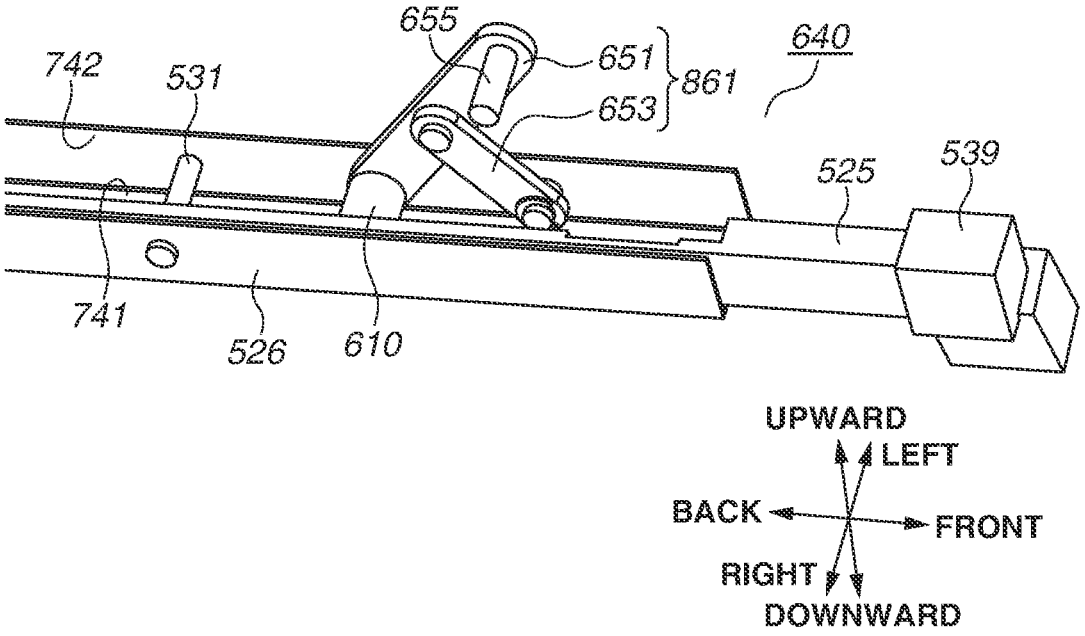

FIG. 6A is a perspective view schematically illustrating the front side of the movement mechanism 640 (first support portion 527 not illustrated) when viewed from the left-hand side. FIG. 6B is a perspective view schematically illustrating the front side of the movement mechanism 640 (the first support portion 527 not illustrated) when viewed from the right-hand side. The movement mechanism 640 includes the slide member 525, a third support portion 526 (support member), and the first link mechanism 861. The third support portion 526 includes a support shaft 531 and an E-shaped stop ring 533. The third support portion 526 includes a wall portion 741 (first wall portion) and a wall portion 742 (second wall portion). The third support portion 526, a long metal member formed of a sheet metal, is disposed on the side opposite the side on which the photosensitive drum 103 is disposed relative to the optical print head 105. As illustrated in FIGS. 6A and 6B, the third support portion 526 is a sheet metal bent in the U shape. Since the third support portion 526 is bent in the U shape, the wall portions 741 and 742 laterally face with each other. The support shaft 531 is inserted into an opening formed in the facing surfaces (the wall portions 741 and 742) of the third support portion 526 processed in the U shape. The support shaft 531 penetrates the right-hand and the left-hand side surfaces of the third support portion 526. The support shaft 531 is stopped on the outside of the left-hand side surface by the E-shaped stop ring 533 so as not to fall out from the opening of the third support portion 526. As illustrated in FIG. 6A, an oblong hole 691 extending in the front-back direction is formed in the slide member 525. The oblong hole 691 laterally penetrates the slide member 525. The support shaft 531 is inserted into the oblong hole 691 of the slide member 525. More specifically, the support shaft 731 connects the wall portions 741 and 742 via the oblong hole 691 formed in the slide member 525.

With the above-described structure, the slide member 525 is regulated in the vertical movement relative to the third support portion 526, and is slidable relative to the third support portion 526 by the length of the oblong hole 691 in the front-back direction.

A slide auxiliary member 539 having a storage space 562 ranging from the left-hand side to downward is attached on one end side of the slide member 525. The slide auxiliary member 539 is fixed to the slide member 525 by a screw from the left-hand side. A pressure portion 561 provided on the cover 558 (described below) is stored in the storage space 562. The relation between the storage space 562 and the pressure portion 561 and structural characteristics thereof will be described below together with the cover 558.

Figure 7A:
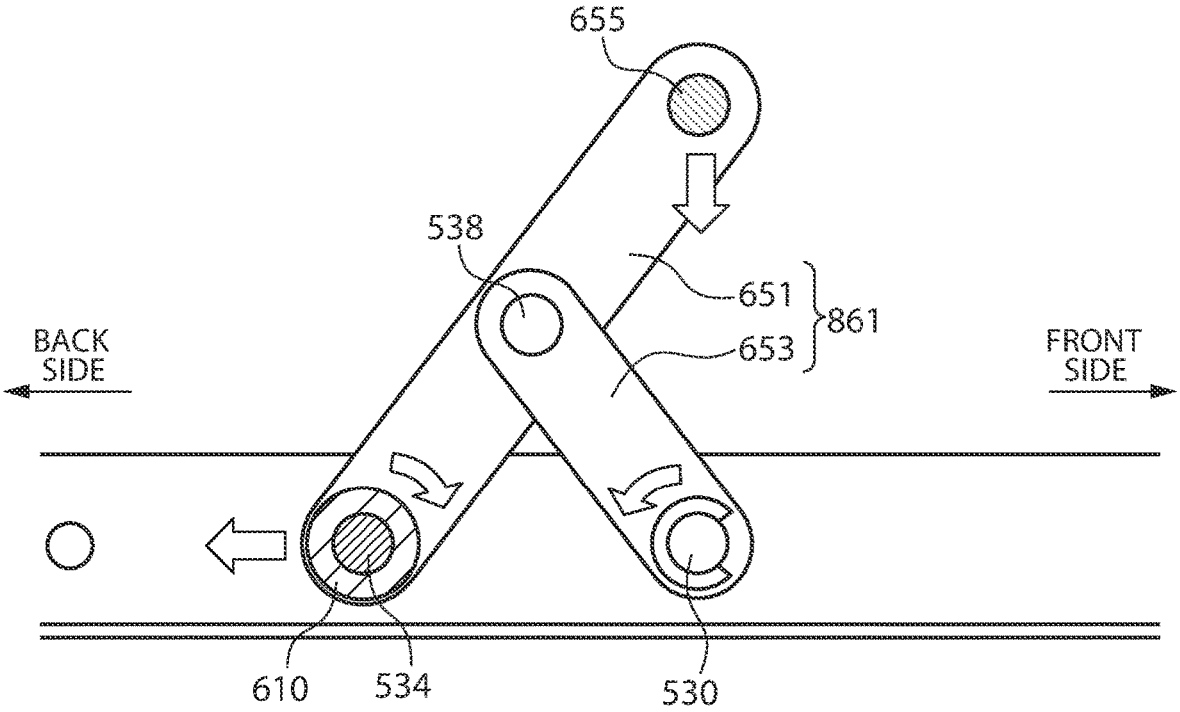
FIGS. 7A and 7B illustrate example operations of link members.

The first link mechanism 861 will be described below with reference to FIGS. 6A, 6B, 7A, and 7B. FIG. 7A is a cross-sectional view illustrating the first link mechanism 861 taken along the plane along the rotational axis of the photosensitive drum 103. The first link mechanism 861 includes the link member 651 (first link member) and the link member 653 (third link member). Although each of the link members 651 and 653 according to the present example embodiment is a single link member, the link members 651 and 653 may be configured with a plurality of link members being combined.

The link member 651 includes a bearing portion 610, a projection 655, and a connection pivot portion 538. The bearing portion 610 is disposed on one end side of the link member 651 in the longitudinal direction of the link member 651. The projection 655 is formed on the other end side of the link member 651 in the longitudinal direction of the link member 651. The projection 655 is a column-shaped projection extending in the direction of the pivotal axis of the link member 651. The connection pivot portion 538 is disposed between the bearing portion 610 and the projection 655 in the longitudinal direction of the link member 651. The projection 655 may be replaced with a structure in which one end side of the link member 651 in the longitudinal direction thereof is bent in the direction of the pivotal axis.

The bearing portion 610 is provided with a circular hollow hole extending in the lateral direction illustrated in FIG. 6A. The slide member 525 is provided with a fitting pivot portion 534. The fitting pivot portion 534 is a column-shaped projection erected from the slide member 525 to the left-hand side illustrated in FIG. 6A. The fitting pivot portion 534 is rotatably fit into the hole of the bearing portion 610. This structure enables the link member 651 to rotate relative to the slide member 525 centering on the center axis of the fitting pivot portion 534. The fitting pivot portion 534 may be formed on the side of the link member 651, and the bearing portion 610 may be formed in the slide member 525.

The projection 655 is a column-shaped projection erected from the link member 651. The projection 655 is rotatably connected to the front side of the holder 505 of the optical print head 105.

The link member 653 is provided with a connection pivot portion 530. The connection pivot portion 530 is disposed on one end side of the link member 653 in the longitudinal direction of the link member 653. The connection pivot portion 530 is a column-shaped projection erected from the link member 653 to the left-hand side illustrated in FIG. 7A. The connection pivot portion 530 is rotatably inserted into a hole formed in the third support portion 526. The connection pivot portion 530 may be formed in the third support portion 526, not in the link member 653. More specifically, the connection pivot portion 530 formed in the third support portion lay be inserted into a hole formed in the link member 653. A circular hole extending in the lateral direction illustrated in FIG. 7A is formed on the other end side of the link member 653 in the longitudinal direction of the link member 653. The connection pivot portion 538 of the link member 651 is rotatably inserted into this hole. More specifically, the link member 653 is rotatable relative to the third support portion 526 centering on the center axis of the connection pivot portion 530. The link member 653 is also rotatable relative to the link member 651 centering on the center axis of the connection pivot portion 538. The connection pivot portion 538 may be formed in the link member 653, not in the link member 651. More specifically, the connection pivot portion 538 formed in the link member 653 may be inserted into a hole formed in the link member 651.

A shaft having a function similar to the support shaft 531 is provided on a back part of the third support portion 526. A hole having a function similar to the oblong hole 691 is formed on a back part of the slide member 525. A structure equivalent to the structure provided on a front part of the movement mechanism 640 is provided on a back part of the movement mechanism 640. The configuration of the second link mechanism 862 is the same as the configuration of the first link mechanism 861 described above. The link members 652 and 654 included in the second link mechanism 862 correspond to the link members 651 and 653, respectively. In the structure of the movement mechanism 640, either the link member 653 or 654 may be omitted.

In summary, one end side of the link member 651 (the side on which the bearing portion 610 is formed) is rotatably connected to the front part of the slide member 525, and the other end (the side on which the projection 655 is formed) thereof is rotatably connected to the front part of the optical print head 105. The link member 651 is obliquely disposed in such a manner that one end side of the link member 651 is positioned downstream, in the slide motion direction (toward the back side), of the other end side thereof. One end side of the link member 652 is rotatably connected to the back part of the slide member 525, and the other end side thereof is rotatably connected to the back part of the optical print head 105. The link member 652 is obliquely disposed in such a manner that one end side of the link member 652 is positioned downstream, in the slide motion direction (toward back side), of the other end side thereof.

On end side of the link member 653 (the side on which the connection pivot portion 530 is formed) is rotatably connected to a front part of the third support portion 526, and the other end side thereof is rotatably connected between one end side and the other end side of the link member 651. The link member 653 is obliquely disposed in such a manner that one end side of the link member 653 is positioned upstream, in the slide motion direction (toward the front side), of the other end side thereof. The connecting portion of the link member 653 and the third support portion 526 is positioned behind the front side end of the slide member 525, in the apparatus main body. More specifically, the slide member 525 is disposed so as to pass on the right-hand side of the link member 653. The slide member 525 may be disposed so as to pass on the left-hand side of the link member 653. Similarly, one end side of the link member 654 is rotatably connected to a front part of the third support portion 526, and the other end side thereof is rotatably connected between one end side and the other end side of the link member 652. The link member 654 is obliquely disposed in such a manner that one end side of the link member 654 is positioned upstream, in the slide motion direction (toward the front side), of the other end side thereof.

In the above-described configuration, when the slide member 525 slides from the front to the back side relative to the third support portion 526, the fitting pivot portion 534 fit into the bearing portion 610 together with the slide member 525 slides from the front to the back side relative to the third support portion 526. Thus, when the first link mechanism 861 is viewed from the right-hand side as illustrated in FIG. 7A, the link member 651 rotates in the clockwise direction centering on the center axis of the fitting pivot portion 534. The link member 653 rotates in the counterclockwise direction centering on the connection pivot portion 530. When the link members 651 and 653 rotate as described above, the projection 655 moves in the direction from the exposure to the evacuation position.

Meanwhile, when the slide member 525 slides from the back to the front side relative to the third support portion 526, the fitting pivot portion 534 fit into the bearing portion 610 together with the slide member 525 slides from the back to the front side relative to the third support portion 526. Thus, when the first link mechanism 861 is viewed from the right-hand side as illustrated in FIG. 7A, the link member 651 rotates in the counterclockwise direction centering on the center axis of the fitting pivot portion 534. The link member 653 rotates in the clockwise direction centering on the connection pivot portion 530. When the link members 651 and 653 rotate as described above, the projection 655 moves in the direction from the evacuation to the exposure position.

The first link mechanism 861 may be structured in reverse in the front-back direction. More specifically, one end side of the first link member 651 may be disposed in front of one end side of the third link member 653. The second link mechanism 862 may be structured in reverse in the front-back direction. More specifically, one end side of a third link member may be disposed in front of one end side of the fourth link member. With this arrangement, when the slide member 525 slides from the front to the back side, the optical print head 105 moves from the evacuation to the exposure position. When the slide member 525 slides from the back to the front side, the optical print head 105 moves from the exposure to the evacuation position. In this case, the cover 558 (described below) pushes the slide member 525 from the front to the back side during the movement from the open to the closed state, and pulls the slide member 525 from the back to the front side during the movement from the closed to the open state.

Figure 7B:
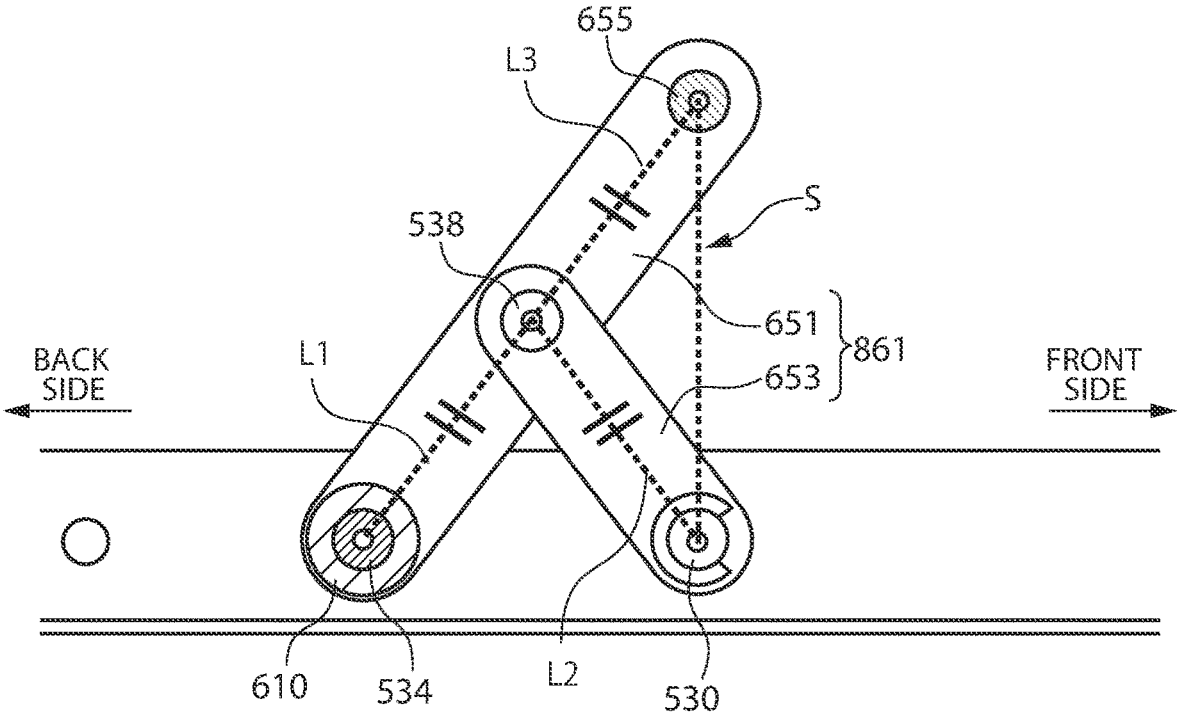

As illustrated in FIGS. 7A and 7B, the longitudinal length of the link member 653 is shorter than the longitudinal length of the link member 651. The first link mechanism 861 and the second link mechanism 862 form a λ-shaped link mechanism.

Here, (1) L1 denotes the distance between the rotation center axis of the connection pivot portion 538 and the rotation center axis of the bearing portion 610. (2) L2 denotes the distance between the rotation center axis of the connection pivot portion 538 and the rotation center axis of the connection pivot portion 530. (3) L3 denotes the distance between the rotation center axis of the connection pivot portion 538 and the rotation center axis of the projection 655. According to the present example embodiment, the first link mechanism 861 includes the Scott Russell mechanism (refer to FIG. 7B) in which the distances L1, L2, and L3 are equal. Equalizing the distances L1, L2, and L3 leads to the projection 655 vertically moving relative to the direction of the slide motion of the fitting pivot portion 534 (along the dotted line S illustrated in FIG. 7B). Thus, the above-described link mechanism enables the optical print head 105 to move in substantially the optical axis direction of the lens. When the optical print head 105 moves in the substantially optical axis direction of the lens, the back side of the holder 505 moves within the gap formed between a first wall surface 588 and a second wall surface 589 of the second support portion 528. This prevents the holder 505 from laterally inclining.

(Example Positional Relations between Link Members and Slide Member)

Positional relations between the link members 651 to 654 and the slide member 525 will be described below with reference to FIGS. 8A to 11.

Figure 8A:
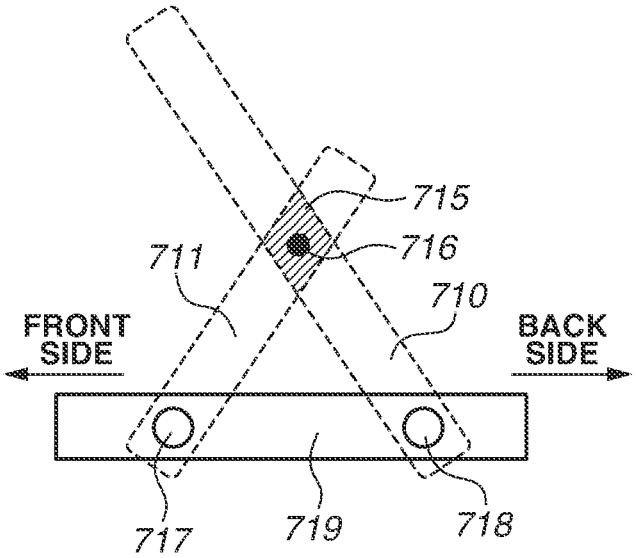
FIGS. 8A to 8C illustrate example positional relations between link members and a slide member.
Figure 8B:
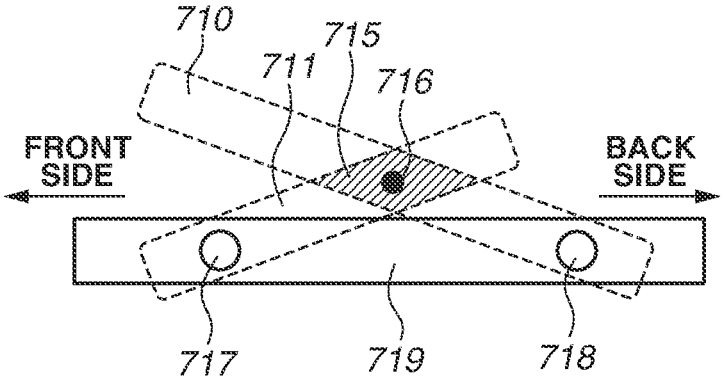
Figure 8C:
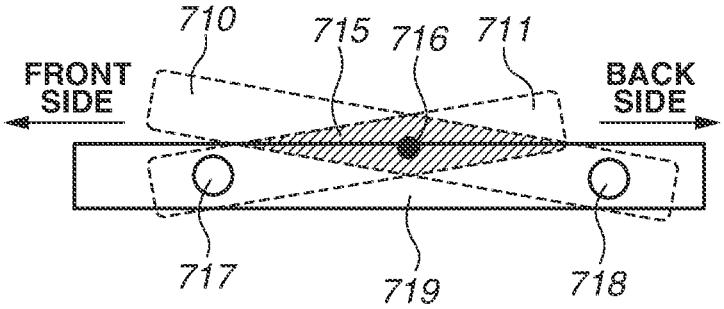

FIGS. 8A to 8C are schematic views illustrating the front side of the movement mechanism 640. Referring to FIGS. 8A to 8C, link members 710 and 711 are equivalent to the link members 651 and 653, respectively, in the movement mechanism 640. A slide member 719 is equivalent to the slide member 525 in the movement mechanism 640. The slide member 719 is positioned closer to the viewer of FIGS. 8A to 8C than both the link members 710 and 711 when paper is viewed from the front side. More specifically, the slide member 719 (slide member 525) is positioned on the right-hand side of the link members 710 and 711 (link members 651 and 653). The slide member 719 (slide member 525) however does not necessarily need to be disposed on the right-hand side of the link members 710 and 711 (link members 651 and 653) and may be disposed on the left-hand side of the link members 710 and 711.

One end side of the link member 710 is provided with a bearing portion 718 into which a projection formed on a front part of the slide member 719 fits. The bearing portion 718 is, for example, a cylinder-shaped bearing with a hollow hole formed therein. The projection formed in the slide member 719 fits into the bearing portion 718. The bearing portion 718 is equivalent to the bearing portion 610 in the movement mechanism 640. The link member 710 rotates relative to the slide member 719 centering on the center axis of the projection fitting into the bearing portion 718. In other words, the link member 710 is rotatably connected to the front part of the slide member 719. Although not illustrated in FIGS. 8A to 8C, as with the link member 651, the other end side of the link member 710 is rotatably connected to a front part of the optical print head 105.

One end side of the link member 711 is rotatably connected to a member fixed to the apparatus main body at a position behind the front side end of the slide member 719. A connection pivot portion 717 is disposed on one end side of the link member 711. The connection pivot portion 717 fits into a bearing fixedly disposed on the apparatus main body. The connection pivot portion 717 is equivalent to the connection pivot portion 538 in the movement mechanism 640. The link member 711 is disposed in such a manner that the other end side of the link member 711 overlaps with one end side of the link member 710 in the lateral direction (the direction of the pivotal axis for the rotation of the link member 710 relative to the slide member 719). A region 715 (intersection region) as a shaded portion illustrated in FIGS. 8A to 8C is a region where the link members 710 and 711 laterally overlap with each other. The link members 710 and 711 are rotatably connected with each other in this intersection region, and a connection pivot portion 716 is formed. The link member 710 (link member 711) rotates relative to the link member 711 (link member 710) centering on the connection pivot portion 716.

The positions of the link members 710 and 711 illustrated in FIG. 8A indicate positions thereof when the optical print head 105 is positioned at the exposure position. The positions of the link members 710 and 711 illustrated in FIG. 8C indicate positions thereof when the optical print head 105 is positioned at the evacuation position. The positions of the link members 710 and 711 illustrated in FIG. 8B indicate positions thereof in a state where the link members are rotating to move the optical print head 105 from the exposure to the evacuation position, in the state illustrated in FIG. 8A, when the slide member 719 slides from the front to the back side of the image forming apparatus 1, each of the link members 710 and 711 rotates. When paper is viewed from the front side, the link member 710 rotates in the counterclockwise direction centering on the bearing portion 718, asset the link member 711 rotates in the clockwise direction centering on the connection pivot portion 717. Accordingly, the other end side of the link member 710 moves to a direction away from the photosensitive drum 103. Although not illustrated, this mechanism is also provided on a back part of the optical print head 105 as in the movement mechanism 640. More specifically, when the user or service engineer slides the slide member 719 from the front to the back side, the optical print head 105 moves from the exposure to the evacuation position.

Referring now to FIG. 8C illustrating a state where the optical print head 105 is positioned at the evacuation position, when paper is viewed from the front side, the slide member 719 is disposed to be positioned in front of the link members 710 and 711, as described above. Thus, when the link members 710 and 711 rotate in order to move the optical print head 105 from the exposure to the evacuation position, at least a part of the intersection region 715 and the slide member 719 laterally overlap with each other. As illustrated in FIGS. 8A to 8C, when the link members 710 and 711 rotate in association with the movement of the slide member 719 from the front to the back side, the intersection region 715 moves to a direction away from the photosensitive drum 103. Even if the entire intersection region 715 laterally overlap with the slide member 719 when the optical print head 105 moves to the evacuation position, the more the intersection region 715 separates away from the photosensitive drum 103, the more the optical print head 105 will also be positioned at a position away from the photosensitive drum 103.

Figure 9A:
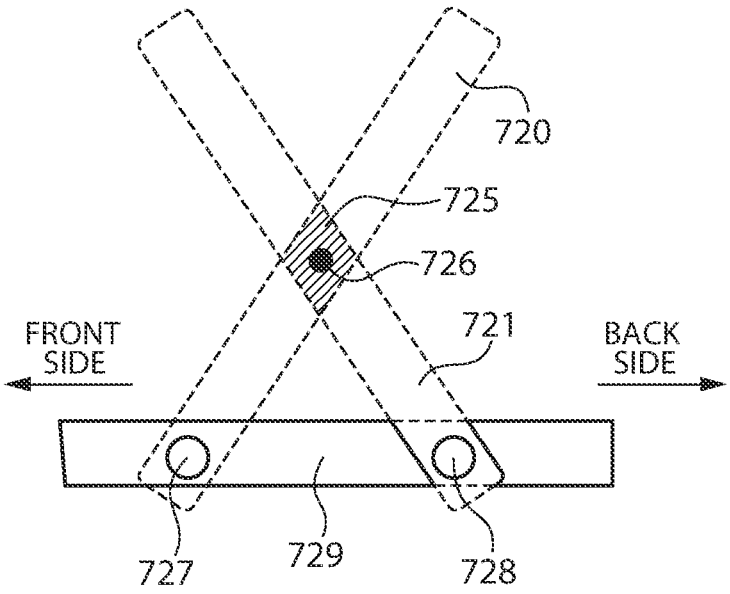
FIG.9A Prior Art
FIGS. 9A and 9B illustrate a comparative example describing positional relations between the link members and the slide member.
Figure 9B:
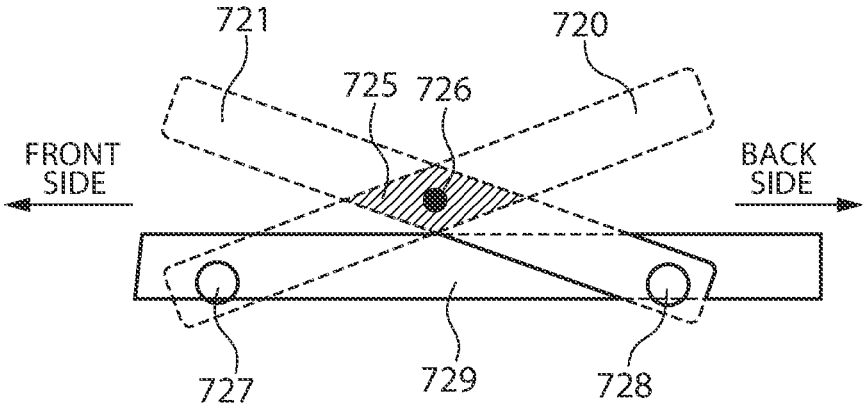
FIG.9B Prior Art

FIGS. 9A and 9B illustrate a comparative example for illustrating a conventional technique. When FIGS. 9A and 9B are viewed from the front side, the slide member 729 is positioned closer to the viewer of FIGS. 9A and 9B than the link member 721 and further to the viewer than the link member 720. More specifically, the slide member 729 and the link members 721 and 720 are disposed so that the link members 721 and 720 sandwich the slide member 729 from one side and the other side of the slide member 729 in the direction of the rotation center axis of the link member 721.

One end side of the link member 721 is provided with a bearing portion 728 into which a projection formed on a front part of the slide member 729 fits. The bearing portion 728 is, for example, a cylinder-shaped bearing with a hollow hole formed therein. The projection formed in the slide member 729 fits into the bearing portion 728. The bearing portion 728 is equivalent to the bearing portion 610 in the movement mechanism 640. This projection fits into a hole formed in the slide member 729 to form the bearing portion 728. The link member 721 rotates relative to the slide member 729 centering on the center axis of the projection fitting into the bearing portion 728. In other words, the link member 721 is rotatably connected to the front part of the slide member 729. Although not illustrated in FIGS. 9A and 9B, the other end side of the link member 721 is rotatably connected to a front part of the optical print head 105.

One end side of the link member 720 is rotatably connected to a member fixed to the apparatus main body at a position behind the front side end of the slide member 729 and forms a connection pivot portion 727. The link member 720 is disposed so that the other end side of the link member 720 overlaps with one end side of the link member 721 in the lateral direction (the direction of the pivotal axis for the rotation of the link member 721 relative to the slide member 729). A region 725 (intersection region) as a shaded portion illustrated in FIGS. 9A and 9B is a region where the link members 720 and 721 laterally overlap with each other. In this intersection region 725, the link members 720 and 721 are rotatably connected with each other, and a connection pivot portion 726 is formed. The link member 720 (link member 721) rotates relative to the link member 721 (link member 720) centering on the connection pivot portion 726.

The positions of the link members 720 and 721 illustrated in FIG. 9A indicate the positions thereof when the optical print head 105 is positioned at the exposure position. The positions of the link members 720 and 721 illustrated in FIG. 9B indicate the positions thereof when the optical print head 105 is positioned at the evacuation position. In the state illustrated in FIG. 9A, when the slide member 729 slides from the front to the back side, each of the link members 720 and 721 rotates. When paper is viewed from the front side, the link member 720 rotates in the counterclockwise direction centering on the center axis of the projection fitting into the bearing portion 728. When paper is viewed from the front side, the link member 721 rotates in the clockwise direction centering on the connection pivot portion 727. Accordingly, the other end side of the link member 720 moves to a direction away from the photosensitive drum 103. Although not illustrated, this mechanism is also provided on a back part of the optical print head 105 in a similar way to the movement mechanism 640. More specifically, when the user or service engineer slides the slide member 729 from the front to the back side, the optical print head 105 moves from the exposure to the evacuation position.

Referring now to FIG. 9B, illustrating a state where the optical print head 105 is positioned at the evacuation position, when FIG. 9B is viewed from the front side, the slide member 729 is disposed to be positioned in front of the link member 720 and behind the link member 721 as described above. Thus, when the link members 720 and 721 rotate in order to move the optical print head 105 from the exposure to the evacuation position, the intersection region 725 and the slide member 729 do not laterally overlap with each other. When the link members 720 and 721 rotate in order to move the optical print head 105 from the exposure to the evacuation position, the upper part of the slide member 729 will contact the link members 720 and 721. Comparing the mechanism according to the present example embodiment illustrated in FIGS. 8A to 8C with the conventional mechanism illustrated in FIGS. 9A and 9B, it turns out that the allowable rotation amount of each of the link members 720 and 721 is limited.

Figure 10A:
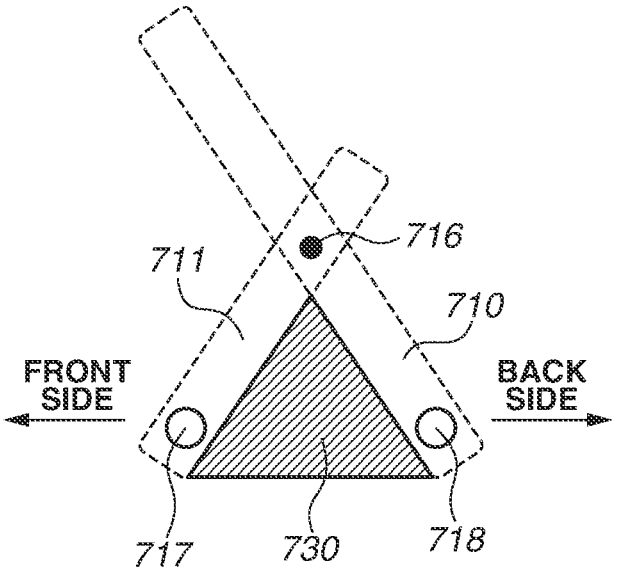
FIGS. 10A to 10C illustrate example link members.
Figure 10B:
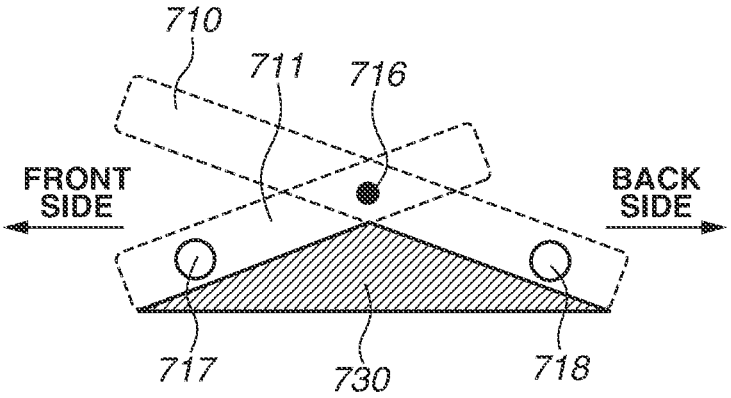
Figure 10C:
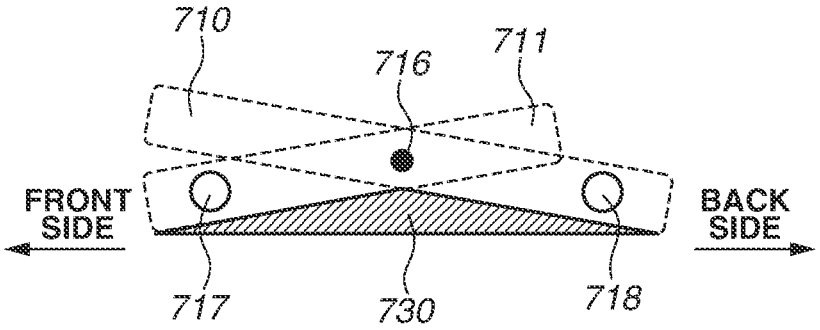

FIGS. 10A to 10C schematically illustrate states where members other than the link members 651 and 653 are removed from the front side of the movement mechanism 640. Referring to FIGS. 10A to 10C, the link members 710 and 711 are equivalent to the link members 651 and 653, respectively, in the movement mechanism 640. The slide member 719 is equivalent to the slide member 525 in the movement mechanism 640. The states of the link members 710 and 711 illustrated in FIGS. 10A, to 10C correspond to the states of the link members 710 and 711 illustrated in FIGS. 8A to 8C, respectively.

A region 730 as a shaded portion illustrated in FIGS. 10A to 10C indicates the region where a region situated upstream, in the slide motion direction (toward the front side), of the link member 710 overlaps with the region situated downstream, in the slide motion direction (toward the back side), of the link member 711, in the lateral direction (the direction of the pivotal axis for the rotation of the link member 710 relative to the slide member 719). In the case of the mechanism based on the conventional technique described above with reference to FIGS. 9A and 9B, the slide member 729 passes through the region 730. In the case of the mechanism according to the present example embodiment described above with reference to FIGS. 8A to 8C, the slide member 719 is disposed outside the region 730. In a case where the slide member 729 is disposed in the region 730 as in the conventional mechanism, when the slide member 729 is slid from the front to the back side and the link members 720 and 721 rotate, the link members 720 and 721 will contact the slide member 729. On the other hand, in a case where the slide member 719 is disposed outside the region 730 as in the movement mechanism 640 according to the present example embodiment, even when the slide member 729 is slid from the front to the back side and the link members 720 and 721 rotate, neither the link member 720 nor the link member 721 will contact the slide member 729.

To prevent the link members 720 and 721 from contacting the slide member 729 as in the conventional mechanism, a method for disposing the slide member 729 below the link members 720 and 721 may be considered. This means a method for disposing the slide member 729 at a position where the slide member 729 overlaps with the region 730 in the vertical direction (the direction perpendicular to both the longitudinal direction of the optical print head 105 and the direction of the pivotal axis of the link member 721). However, disposing the slide member 729 in this way is not desirable since the entire exposure unit increases in size in the vertical direction. In addition, as a result of the vertically increased size of the entire exposure unit, the optical print head 105 will be disposed closer to the photosensitive drum 103. In the movement mechanism 640 according to the present example embodiment, the slide member 525 is not disposed at a position where the slide member 525 vertically overlaps with the link members 651 to 654.

Figure 11:
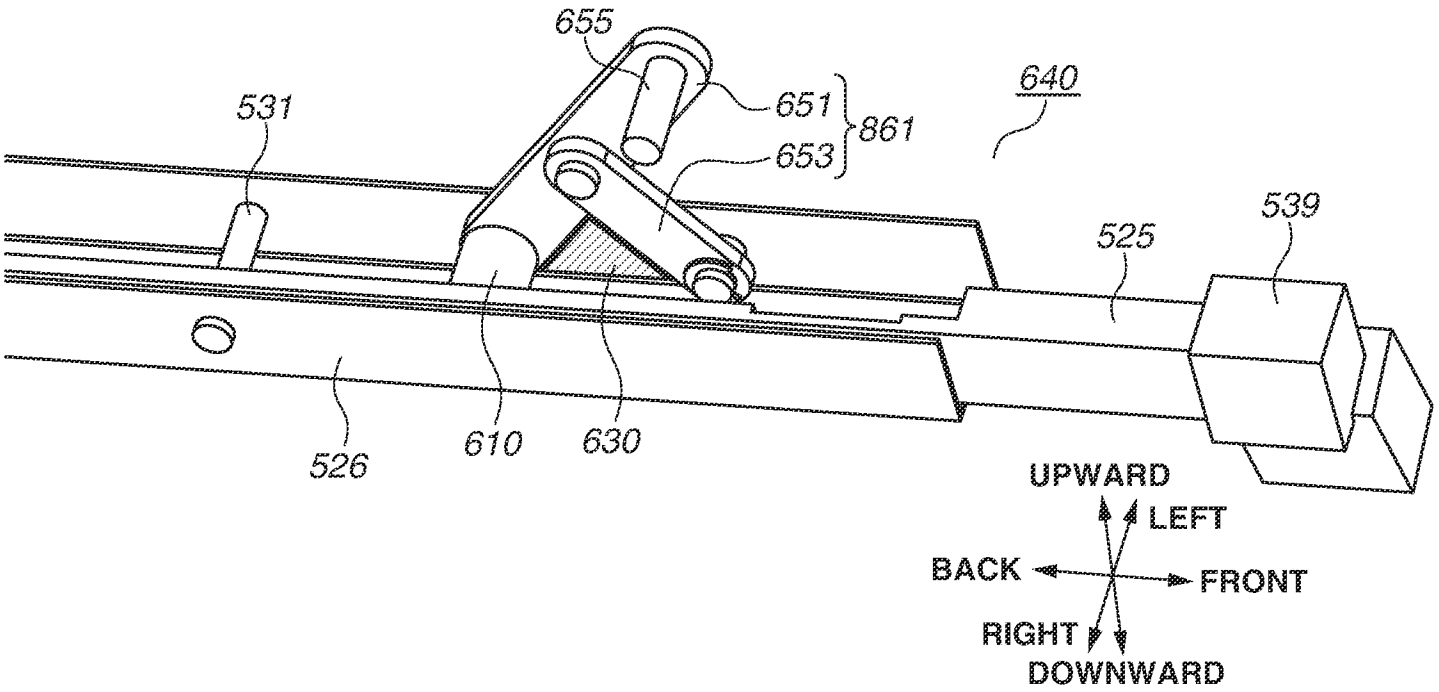
FIG. 11 illustrates the link members disposed on a front part of the movement mechanism.

FIG. 11 is a perspective view schematically illustrating a front part of the movement mechanism 640. A region 630 as a shaded portion illustrated in FIG. 11 indicates the region where the region in front of the link member 651 laterally overlaps with the region behind the link member 653. As described above with reference to FIGS. 10A to 10C, the slide member 525 is not disposed in the region 630. The slide member 525 is disposed with a gap between the slide member 525 and the region 630 in the lateral direction.

(Example Cartridge Covers)

A cover 558 will be described below with reference to FIGS. 12A to 12D.

Figure 12A:
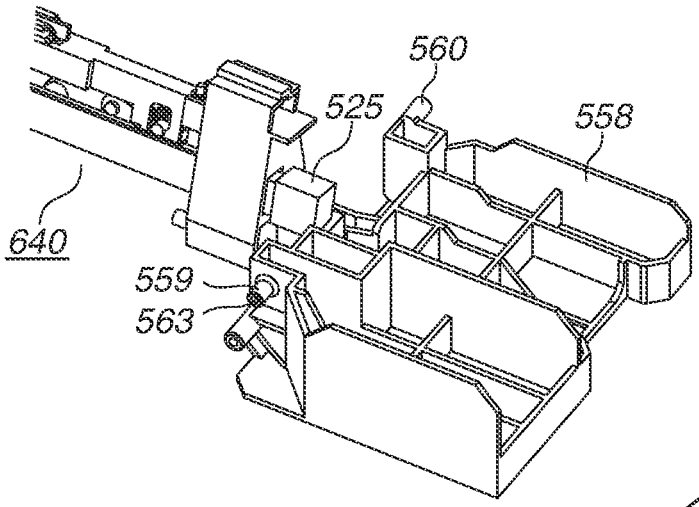
FIGS. 12A to 12D are perspective views schematically illustrating an example cover.
Figure 12B:
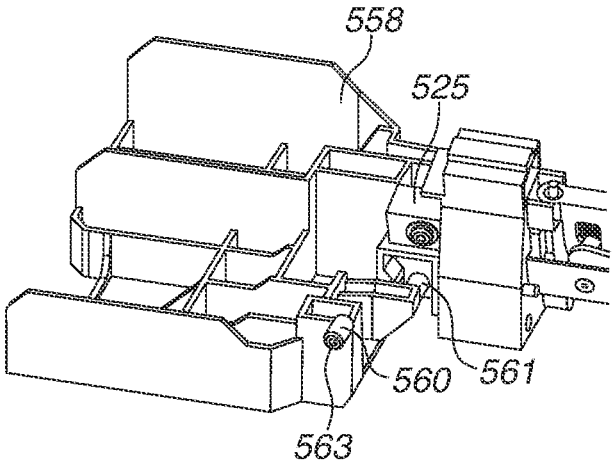
Figure 12C:
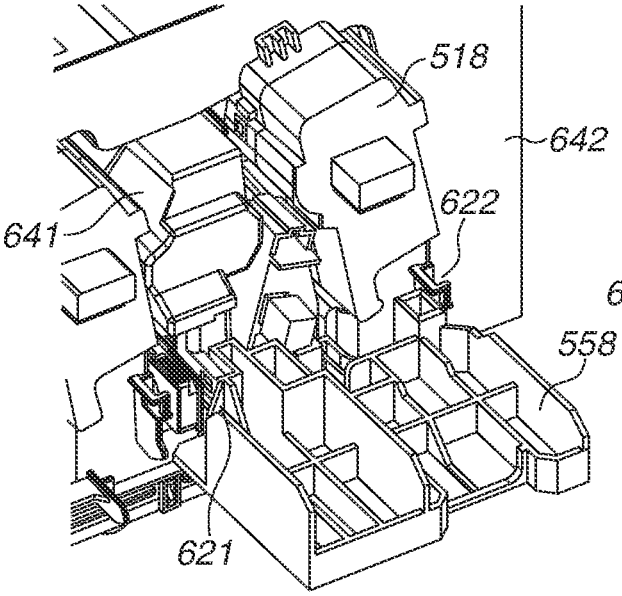
Figure 12D:
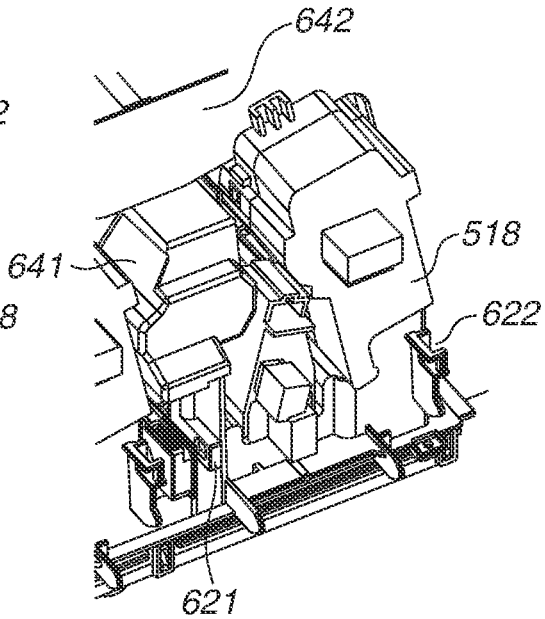

FIG. 12A is a perspective view illustrating the cover 558 attached to the movement mechanism 640 when viewed from the right-hand side. FIG. 12B is a perspective view illustrating the cover 558 attached to the movement mechanism 640 when viewed from the left-hand side. FIG. 12C illustrates the front side plate 642 with the cover 558 attached thereto. FIG. 12D illustrates the front side plate 642 with the cover 558 not illustrated. The worker, such as the user and maintenance engineer, can remove the drum unit 518 from the apparatus main body by opening the cover 558 (FIG. 12C). The closed cover 558 is positioned on the insertion/removal path of the drum unit 518 and the development unit 641. Thus, when the cover 558 is closed, the worker cannot perform a work for replacing the drum unit 518 and the development unit 641. By opening the cover 558, the worker can replace the drum unit 518. The worker closes the cover 558 after completion of the replacement work.

As illustrated in FIGS. 12A and 12B, the cover 558 is provided with pivot portions 559 and 560 and a pressure portion 561. The pivot portion 559 is a column-shaped projection projecting to the right-hand side of the cover 558. The pivot portion 560 is a column-shaped projection projecting to the left-hand side of the cover 558. A pivotal axis 563 is the rotation center axis of the cover 558 rotating centering on the pivot portions 559 and 560.

As illustrated in FIG. 12B, the pressure portion 561 is positioned in a space provided at the front side of the slide member 525 in the longitudinal direction of the slide member 525, in a state where the cover 558 is attached to the front side plate 642. When the cover 558 rotates centering on the pivotal axis 563, the pressure portion 561 moves the slide member 525 forward and backward in association with the rotation. More specifically, when the worker rotates the cover 558 from the closed to the open state, the pressure portion 561 moves the slide member 525 from the front to the back side. In association with the movement of the slide member 525 from the front to the back side, the optical print head 105 moves from the exposure to the evacuation position. In short, when the worker opens the cover 558, the optical print head 105 moves to the evacuation position, increasing the gap between the photosensitive drum 103 and the optical print head 105. Thus, the worker can perform a work for replacing the drum unit 518 without allowing the contact between the drum unit 518 on the optical print head 105. On the other hand, when the worker rotates the cover 558 from the open to the closed state, the pressure portion 561 moves the slide member 525 from the back to the front side. In association with the movement of the slide member 525 from the back to the front side, the optical print head 105 moves from the evacuation to the exposure position.

The configuration for sliding the slide member 525 is not limited to the cover 558. For example, the slide member 525 may be configured to slide in association with the opening and closing of a front door (not illustrated). The slide member 525 may be configured to slide in association with the rotation of a rotation member such, as a lever, instead of a covering member, such as the cover 558 and a door.

As illustrated in FIGS. 12C and 12D, the front side plate 642 is provided with a bearing member 621 into which the pivot portion 559 of the cover 558 fits, and a bearing member 622 into which the pivot portion 560 fits. As illustrated in FIG. 12C, the pivot portion 559 of the cover 558 rotatably fits into the bearing member 621 of the front side plate 642, and the pivot portion 560 rotatably fits into the bearing member 622 of the front side plate 642.

According to the present example embodiment, the optical print head 105 can be evacuated from the photosensitive drum 103 to a further extent than the conventional structure according to the comparative example illustrated in FIGS. 9A and 9B.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-093254, filed May 14, 2018, which is hereby incorporated by reference herein in its entirety.

What is claimed is:

1. An image forming apparatus comprising:

a photosensitive drum configured to be rotatable relative to a main body of the image forming apparatus;

an optical print head configured to be movable from an exposure position for exposing the photosensitive drum to light to a retracted position farther away from the photosensitive drum than the exposure position;

a sliding portion configured to movably slide from a front part of the main body of the image forming apparatus to a back part of the main body along a longitudinal direction of the optical print head;

a first link member rotatably connected to the sliding portion and the optical print head;

a second link member rotatably connected to the sliding portion and the optical print head, wherein one end side of the first link member in a longitudinal direction of the first link member is rotatably connected to a front part of the sliding portion in a longitudinal direction of the optical print head, and the other end side of the first link member in a longitudinal direction of the first link member is rotatably connected to a front part of the optical print head in a longitudinal direction of the optical print head, and the one end side of the first link member in a longitudinal direction of the first link member is positioned at a downstream side of the other end side of the first link member in the longitudinal direction of the first link member in a sliding movement direction in which the sliding portion slides, and wherein one end side of the second link member in a longitudinal direction of the second link member is rotatably connected to a back part of the sliding portion in a longitudinal direction of the optical print head, and the other end side of the second link member in a longitudinal direction of the second link member is rotatably connected to a back part of the optical print head in a longitudinal direction of the optical print head, and the one end side of the second link member in a longitudinal direction of the second link member is positioned at a downstream side of the other end side of the second link member in a longitudinal direction of the second link member in the sliding movement direction; and a third link member rotatably connected to the main body of the image forming apparatus and the first link member, wherein one end side of the third link member in the longitudinal direction of the third link member is rotatably connected to the main body of the image forming apparatus at an upstream side of the one end side of the first link member in a longitudinal direction of the first link member in the sliding movement direction, and the other end side of the third link member in the longitudinal direction of the third link member is rotatably connected to the first link member at a downstream side of the one end side of the third link member in the longitudinal direction of the third link member in the sliding movement direction, wherein the first link member, the second link member, and the third link member rotate in association with sliding movement of the sliding portion, and move the optical print head from the exposure position to the retracted position, and wherein, when the optical print head is positioned at the retracted position, at least a part of a region where the first and the third link members overlap with each other in a pivotal axis direction being the direction of a pivotal axis of the third link member rotating relative to the first link member and the sliding portion overlap with each other in the pivotal axis direction.

2. The image forming apparatus according to claim 1, wherein the first link member is connected to the sliding portion from one side than the sliding portion in the pivotal axis direction, and wherein the third link member is connected to the main body of the image forming apparatus on one side than the sliding portion in the pivotal axis direction in the pivotal axis direction.

3. The image forming apparatus according to claim 1, wherein the first and the third link members are disposed on one side or an opposite side, in the pivotal axis direction, of the sliding portion.

4. The image forming apparatus according to claim 1, further comprising a fourth link member rotatably connected to the main body of the image forming apparatus and the second link member, and wherein one end side of the fourth link member in the longitudinal direction of the fourth link member is rotatably connected to the main body of the image forming apparatus at an upstream side of the one end side of the second link member in the longitudinal direction of the second link member in the sliding movement direction, and the other end side of the fourth link member in the longitudinal direction of the fourth link member is rotatably connected to the second link member at a downstream side of the one end side of the fourth link member in the longitudinal direction of the fourth link member in the sliding movement direction.

5. The image forming apparatus according to claim 4, wherein the first link member is connected to the sliding portion from one side than the sliding portion in the pivotal axis direction, wherein the third link member is connected to the main body of the image forming apparatus on one side than the sliding portion in the pivotal axis direction, wherein the second link member is connected to the sliding portion from one side than the sliding portion in the pivotal axis direction, and wherein the fourth link member is connected to the main body of the image forming apparatus on one side than the sliding portion in the pivotal axis direction.

6. The image forming apparatus according to claim 4, wherein the first and the third link members are disposed on one side or an opposite side than the sliding portion in the pivotal axis direction, and wherein the second and the fourth link members are disposed on one side or an opposite side than the sliding portion in the pivotal axis direction.

7. The image forming apparatus according to claim 4, further comprising a long support member fixed to the main body of the image forming apparatus on a side opposite a side where the photosensitive drum is disposed with respect to the optical print head, and slidably supporting the sliding portion, wherein the support member comprises:

a first wall portion disposed on one side than the sliding portion in the pivotal axis direction, a second wall portion provided on an opposite side than the sliding portion in the pivotal axis direction; and a support shaft configured to connect the first and the second wall portions via an oblong hole, formed in the sliding portion along the longitudinal direction of the optical print head, penetrating in the pivotal axis direction, in order to slidably support the sliding portion disposed between the first and the second wall portions in the pivotal axis direction.

8. The image forming apparatus according to claim 7, further comprising:

a front side plate forming a part of a housing of the main body of the image forming apparatus on a front side of the main body of the image forming apparatus; and a back side plate forming a part of the housing of the main body of the image forming apparatus on a back side of the main body of the image forming apparatus, wherein a front part of the support member in the longitudinal direction is fixed to the front side plate, and a back part of the support member in the longitudinal direction is fixed to the back side plate.

9. The image forming apparatus according to claim 8, wherein one end side of the third link member is rotatably connected to the support member.

10. An image forming apparatus comprising:

a photosensitive drum configured to be rotatable relative to a main body of the image forming apparatus;

an optical print head configured to be movable from an exposure position for exposing the photosensitive drum to light to a retracted position farther away from the photosensitive drum than the exposure position;

a sliding portion configured to movably slide from a front part of the main body of the image forming apparatus to a back part of the main body along a longitudinal direction of the optical print head;

a first link member rotatably connected to the sliding portion and the optical print head;

a second link member rotatably connected to the sliding portion and the optical print head, wherein one end side of the first link member in a longitudinal direction of the first link member is rotatably connected to a front part of the sliding portion in a longitudinal direction of the optical print head, and the other end side of the first link member in a longitudinal direction of the first link member is rotatably connected to a front part of the optical print head in a longitudinal direction of the optical print head, and the one end side of the first link member in a longitudinal direction of the first link member is positioned at a downstream side of the other end side of the first link member in the longitudinal direction of the first link member in a sliding movement direction in which the sliding portion slides, and wherein one end side of the second link member in a longitudinal direction of the second link member is rotatably connected to a back part of the sliding portion in a longitudinal direction of the optical print head, and the other end side of the second link member in a longitudinal direction of the second link member is rotatably connected to a back part of the optical print head in a longitudinal direction of the optical print head, and the one end side of the second link member in a longitudinal direction of the second link member is positioned at a downstream side of the other end side of the second link member in the longitudinal direction of the second link member in the sliding movement direction; and a third link member rotatably connected to the main body of the image forming apparatus and the second link member, wherein one end side of the third link member in the longitudinal direction of the third link member is rotatably connected to the main body of the image forming apparatus at an upstream side of the one end side of the second link member in the longitudinal direction of the second link member in the sliding movement direction, and the other end side of the third link member in the longitudinal direction of the third link member is connected to the second link member at a downstream side of the one end side of the third link member in the longitudinal direction of the third link member in the sliding movement direction, wherein the first link member, the second link member, and the third link member rotate in association with sliding movement of the sliding portion, and move the optical print head from the exposure position to the evacuation position, and wherein, when the optical print head is positioned at the retracted position, at least a part of a region where the second and the third link members overlap with each other in a pivotal axis direction being the direction of a pivotal axis of the third link member rotating relative to the second link member and the sliding portion overlap with each other in the pivotal axis direction.

11. The image forming apparatus according to claim 10, wherein the second link member is connected to the sliding portion from one side than the sliding portion in the pivotal axis direction, and wherein the third link member is connected to the main body of the image forming apparatus on one side than the sliding portion in the pivotal axis direction.

12. The image forming apparatus according to claim 10, wherein the first and the third link members are disposed on one side or an opposite side than the sliding portion in the pivotal axis direction.

13. An image forming apparatus comprising:

a photosensitive drum configured to be rotatable relative to a main body of the image forming apparatus;

an optical print head configured to be movable from an exposure position for exposing the photosensitive drum to light to a retracted position farther away from the photosensitive drum than the exposure position;

a sliding portion configured to movably slide from a back part of the main body of the image forming apparatus to a front part of the main body along a longitudinal direction of the optical print head;

a first link member rotatably connected to the sliding portion and the optical print head;

a second link member rotatably connected to the sliding portion and the optical print head, wherein one end side of the first link member in a longitudinal direction of the first link member is rotatably connected to a front part of the sliding portion in a longitudinal direction of the optical print head, and the other end side of the first link member in a longitudinal direction of the first link member is rotatably connected to a front part of the optical print head in a longitudinal direction of the optical print head, and the one end side of the first link member in a longitudinal direction of the first link member is positioned at a downstream side of the other end side of the first link member in a longitudinal direction of the first link member in a sliding movement direction in which the sliding portion slides, and wherein one end side of the second link member in a longitudinal direction of the second link member is rotatably connected to a back part of the sliding portion in a longitudinal direction of the optical print head, and the other end side of the second link member in a longitudinal direction of the second link member is rotatably connected to a back part of the optical print head in a longitudinal direction of the optical print head, and the one end side of the second link member in a longitudinal direction of the second link member is positioned at a downstream side of the other end side of the second link member in a longitudinal direction of the second link member in the sliding movement direction; and a third link member rotatably connected to the main body of the image forming apparatus and the first link member, wherein one end side of the third link member in a longitudinal direction of the third link member is rotatably connected to the main body of the image forming apparatus at an upstream side of the one end side of the first link member in the longitudinal direction of the first link member in the sliding movement direction, and the other end side of the third link member in a longitudinal direction of the third link member is connected to the first link member at a downstream side of the one end side of the third link member in the longitudinal direction of the third link member in the sliding movement direction, wherein the first link member, the second link member, and the third link member rotate in association with sliding movement of the sliding portion, and move the optical print head from the exposure position to the retracted position, and wherein, when the optical print head is positioned at the retracted position, at least a part of a region where the first and the third link members overlap with each other in a pivotal axis direction being the direction of a pivotal axis of the third link member rotating relative to the first link member and the sliding portion overlap with each other in the pivotal axis direction.

14. The image forming apparatus according to claim 13, wherein the first link member is connected to the sliding portion from one side than the sliding portion in the pivotal axis direction, and wherein the third link member is connected to the main body of the image forming apparatus on one side than the sliding portion in the pivotal axis direction.

15. The image forming apparatus according to claim 13, wherein the first and the third link members are disposed on one side or an opposite side than the sliding portion in the pivotal axis direction.

16. The image forming apparatus according to claim 13, further comprising a fourth link member rotatably connected to the main body of the image forming apparatus and the second link member, and wherein one end side of the fourth link member in the longitudinal direction of the fourth link member is rotatably connected to the main body of the image forming apparatus at an upstream side of the one end side of the second link member in the longitudinal direction of the second link member in the sliding movement direction, and the other end side of the fourth link member in the longitudinal direction of the fourth link member is connected to the second link member at a downstream side of the one end side of the fourth link member in the longitudinal direction of the fourth link member in the sliding movement direction.

17. The image forming apparatus according to claim 16, wherein the first link member is connected to the sliding portion from one side than the sliding portion in the pivotal axis direction, wherein the third link member is connected to the main body of the image forming apparatus on one side or an opposite side than the sliding portion in the pivotal axis direction, wherein the second link member is connected to the sliding portion from one side than the sliding portion in the pivotal axis direction, and wherein the fourth link member is connected to the main body of the image forming apparatus on one side than the sliding portion in the pivotal axis direction.

18. The image forming apparatus according to claim 16, wherein the first and the third link members are disposed on one side or an opposite side than the sliding portion in the pivotal axis direction, and wherein the second and the fourth link members are disposed on one side or an opposite side than the sliding portion in the pivotal axis direction.

19. The image forming apparatus according to claim 16, further comprising a long support member fixed to the main body of the image forming apparatus on a side opposite a side where the photosensitive drum is disposed with respect to the optical print head and slidably supporting the sliding portion, wherein the support member comprises:

a first wall portion disposed on one side than the sliding portion in the pivotal axis direction, a second wall portion provided on an opposite side than the sliding portion in the pivotal axis direction; and a support shaft configured to connect the first and the second wall portions via an oblong hole, formed in the sliding portion along the longitudinal direction of the optical print head, penetrating in the pivotal axis direction, in order to slidably support the sliding portion disposed between the first and the second wall portions in the pivotal axis direction.

20. The image forming apparatus according to claim 19, further comprising:

a front side plate forming a part of a housing of the main body of the image forming apparatus on a front side of the main body of the image forming apparatus; and a back side plate forming a part of the housing of the main body of the image forming apparatus on a back side of the main body of the image forming apparatus, wherein a front part of the support member in the longitudinal direction is fixed to the front side plate, and a back part of the support member in the longitudinal direction is fixed to the back side plate.

21. The image forming apparatus according to claim 20, wherein one end side of the third link member is rotatably connected to the support member.

22. An image forming apparatus comprising:

a photosensitive drum configured to be rotatable relative to a main body of the image forming apparatus;

an optical print head configured to be movable from an exposure position for exposing the photosensitive drum to light to a retracted position farther away from the photosensitive drum than the exposure position;

a sliding portion configured to movably slide from a back part of the main body of the image forming apparatus to a front part of the main body along a longitudinal direction of the optical print head;

a first link member rotatably connected to the sliding portion and the optical print head;

a second link member rotatably connected to the sliding portion and the optical print head, wherein one end side of the first link member in a longitudinal direction of the first link member is rotatably connected to a front part of the sliding portion in a longitudinal direction of the optical print head, and the other end side of the first link member in a longitudinal direction of the first link member is rotatably connected to a front part of the optical print head in a longitudinal direction of the optical print head, and the one end side of the first link member in a longitudinal direction of the first link member is positioned at a downstream side of the other end side of the first link member in the longitudinal direction of the first link member in a sliding movement direction in which the sliding portion slides, and wherein one end side of the second link member in a longitudinal direction of the second link member is rotatably connected to a back part of the sliding portion in the longitudinal direction of the optical print head, and the other end side of the second link member in the longitudinal direction of the second link member is rotatably connected to a back part of the optical print head in the longitudinal direction of the optical print head, and the one end side of the second link member in the longitudinal direction of the second link member is positioned at a downstream side of the other end side of the second link member in the longitudinal direction of the second link member in the sliding movement direction; and a third link member rotatably connected to the main body of the image forming apparatus and the second link member, wherein one end side of the third link member in a longitudinal direction of the third link member is rotatably connected to the main body of the image forming apparatus at an upstream side of the one end side of the second link member in the longitudinal direction of the second link member in the sliding movement direction, and the other end side of the third link member in a longitudinal direction of the third link member is connected to the second link member at a downstream side of the one end side of the third link member in the longitudinal direction of the third link member in the sliding movement direction, wherein the first link member, the second link member, and the third link member rotate in association with sliding movement of the sliding portion, and move the optical print head from the exposure position to the retracted position, and wherein, when the optical print head is positioned at the retracted position, at least a part of a region where the second and the third link members overlap with each other in a pivotal axis direction being the direction of a pivotal axis of the third link member rotating relative to the first link member and the sliding portion overlap with each other in the pivotal axis direction.

23. The image forming apparatus according to claim 22, wherein the second link member is connected to the sliding portion from one side than the sliding portion in the pivotal axis direction, and wherein the third link member is connected to the main body of the image forming apparatus on one side than the sliding portion in the pivotal axis direction.

24. The image forming apparatus according to claim 22, wherein the first and the third link members are disposed on one side or an opposite side than the sliding portion in the pivotal axis direction.

* * * * *